US010980331B2

(12) United States Patent
Kinoshita et al.

(10) Patent No.: US 10,980,331 B2
(45) Date of Patent: Apr. 20, 2021

(54) EYE COSMETIC APPLICATOR AND EYE COSMETIC TOOL

(71) Applicant: SHISEIDO COMPANY, LTD., Tokyo (JP)

(72) Inventors: Suguru Kinoshita, Kanagawa (JP); Motoki Takata, Kanagawa (JP); Miyako Okamoto, Tokyo (JP)

(73) Assignee: SHISEIDO COMPANY, LTD, Tokyo (JP)

( * ) Notice: Subject to any disclaimer, the term of this patent is extended or adjusted under 35 U.S.C. 154(b) by 194 days.

(21) Appl. No.: 16/065,240

(22) PCT Filed: Dec. 27, 2016

(86) PCT No.: PCT/JP2016/088994
§ 371 (c)(1),
(2) Date: Jun. 22, 2018

(87) PCT Pub. No.: WO2017/115825
PCT Pub. Date: Jul. 6, 2017

(65) Prior Publication Data

US 2019/0281951 A1 Sep. 19, 2019

(30) Foreign Application Priority Data

Dec. 28, 2015 (JP) ..... JP2015-257289
Dec. 27, 2016 (JP) ..... JP2016-253284

(51) Int. Cl.
*A45D 34/04* (2006.01)
*A46B 9/02* (2006.01)

(52) U.S. Cl.
CPC ..... *A45D 34/04* (2013.01); *A46B 9/021* (2013.01); *A46B 2200/106* (2013.01); *A46B 2200/1053* (2013.01)

(58) Field of Classification Search
CPC .... A45D 34/04; A45D 34/045; A45D 34/046; A45D 40/265; A45D 40/267;
(Continued)

(56) References Cited

U.S. PATENT DOCUMENTS 4,498,490 A * 2/1985 Seidler ..... A45D 34/046 132/218
4,527,575 A 7/1985 Vasas
(Continued)

FOREIGN PATENT DOCUMENTS

CN 1170497 10/2004
EP 2225963 9/2010
(Continued)

OTHER PUBLICATIONS

International Search Report for PCT/JP2016/088994 dated Mar. 7, 2017.
(Continued)

*Primary Examiner* — Rachel R Steitz
*Assistant Examiner* — Karim Asqiriba
(74) *Attorney, Agent, or Firm* — IPUSA, PLLC

(57) ABSTRACT

An eye cosmetic applicator capable of obtaining a good makeup effect while reducing fear of contacting to an eyeball or an eyelid when applying liquid mascara to roots of eyelashes. An eye cosmetic applicator 40 includes a spindle 20; a base portion 19 supported by the spindle; and a plurality of protrusions 13, formed at the base portion, each extending in a direction perpendicular to a longitudinal direction of the base portion, wherein each of the protrusions 13 is formed to protrude from a front surface 11 of the base portion 19, and wherein each of the protrusions 13 includes a protruding portion 132 protruding outwardly from a periphery 111 of the base portion 19.

13 Claims, 14 Drawing Sheets

(58) Field of Classification Search
CPC ..... A45D 40/262; A45D 2/48; A45D 34/042; A46B 2200/10; A46B 2200/106; A46B 2200/1046; A46B 2200/1053; A46B 2200/1072; A46B 9/021
USPC ..... D4/114, 116, 119, 128, 131; 401/38, 39
See application file for complete search history.

(56) References Cited

U.S. PATENT DOCUMENTS

| | | | | |
|---|---|---|---|---|
| 6,412,496 | B1 * | 7/2002 | Gueret | A45D 40/267 132/218 |
| 8,127,777 | B2 * | 3/2012 | Gueret | A45D 40/267 132/218 |
| 10,729,230 | B2 * | 8/2020 | Prade | A46B 9/021 |
| 2003/0089379 | A1 * | 5/2003 | Gueret | A45D 34/046 132/218 |
| 2003/0213498 | A1 * | 11/2003 | Gueret | A46B 9/028 132/218 |
| 2005/0217691 | A1 * | 10/2005 | Petit | A46B 9/021 132/320 |
| 2013/0045039 | A1 | 2/2013 | Jeong | |
| 2015/0110540 | A1 * | 4/2015 | Uresti | A46B 9/021 401/129 |
| 2015/0110541 | A1 * | 4/2015 | Uresti | A46B 3/005 401/129 |
| 2017/0360179 | A1 * | 12/2017 | Manici | A45D 40/267 |

FOREIGN PATENT DOCUMENTS

| | | |
|---|---|---|
| JP | S61-199807 | 9/1986 |
| JP | H01-127511 U | 8/1989 |
| JP | 2005-192996 | 7/2005 |
| JP | 2006-169229 | 6/2006 |
| JP | 2008-114058 | 5/2008 |
| JP | 2013-538065 | 10/2013 |
| JP | 2015-047360 | 3/2015 |

OTHER PUBLICATIONS

Extended European Search Report for 16881799.7 dated Jul. 18, 2019.
Office Action issued in the counterpart Chinese Patent Application No. 201680076036.5, dated Jul. 3, 2020.

* cited by examiner

EYE COSMETIC APPLICATOR AND EYE COSMETIC TOOL

BACKGROUND OF THE INVENTION

1. Field of the Invention

The present invention relates to an eye cosmetic applicator, in particular, an eye cosmetic applicator for applying a cosmetic such as liquid mascara, an eyelash enhancing agent, a mascara primer, an eyelash coating agent or a coating agent for eyelash extension, and an eye cosmetic tool in which the eye cosmetic applicator is applied.

2. Description of the Related Art

There are various cosmetic tools that are used when making up, and as one of them, a mascara applicator is used when applying mascara (liquid). By applying liquid mascara, eyelashes can be thickened, elongated and curled.

When applying mascara, in order to thicken eyelashes and make finishing of the eyelashes beautiful, it is preferable that the liquid mascara is firmly applied from edges (roots) of the eyelashes to tips of the eyelashes.

Conventionally, a brush radially protruding from a stem is used as a mascara applicator (Patent Document 1, for example).

Patent Document

[Patent Document 1] Japanese Translation of PCT International Application Publication No. 2013-538065

However, when the brush is used as the mascara applicator, as lengths of fibers of the brush are long and as they are radially protruding, a user may feel fear that a front end of the mascara brush contacts an eyelid or an eyeball.

Further, when the applicator contacts the roots of the eyelashes, as a front end of the brush or a comb contact an eyelid through a space between the eyelashes, a user may latently try to avoid adhesion of the liquid mascara to the eyelid.

Thus, there is a problem in the conventional mascara applicator that the liquid mascara (cosmetic) cannot be firmly applied to the roots of the eyelashes.

SUMMARY OF THE INVENTION

The present invention is made in light of the above problems, and provides an eye cosmetic applicator capable of obtaining a good makeup effect while reducing fear of contacting to an eyeball or an eyelid when applying liquid mascara to roots of eyelashes.

The above described problem can be solved by an eye cosmetic applicator, including a spindle; a base portion supported by the spindle; and a plurality of protrusions, formed at a front surface of the base portion, each extending in a direction perpendicular to a longitudinal direction of the base portion, wherein each of the protrusions is formed to protrude from the front surface of the base portion, and wherein each of the protrusions includes a protruding portion protruding outwardly from a periphery of the base portion.

According to an embodiment, in an eye cosmetic applicator, a good makeup effect can be obtained while reducing fear of contacting to an eyeball or an eyelid when applying to roots of eyelashes.

DETAILED DESCRIPTION

Embodiments of the invention are described with reference to drawings.

(Eye Cosmetic Tool)

Figure 1:
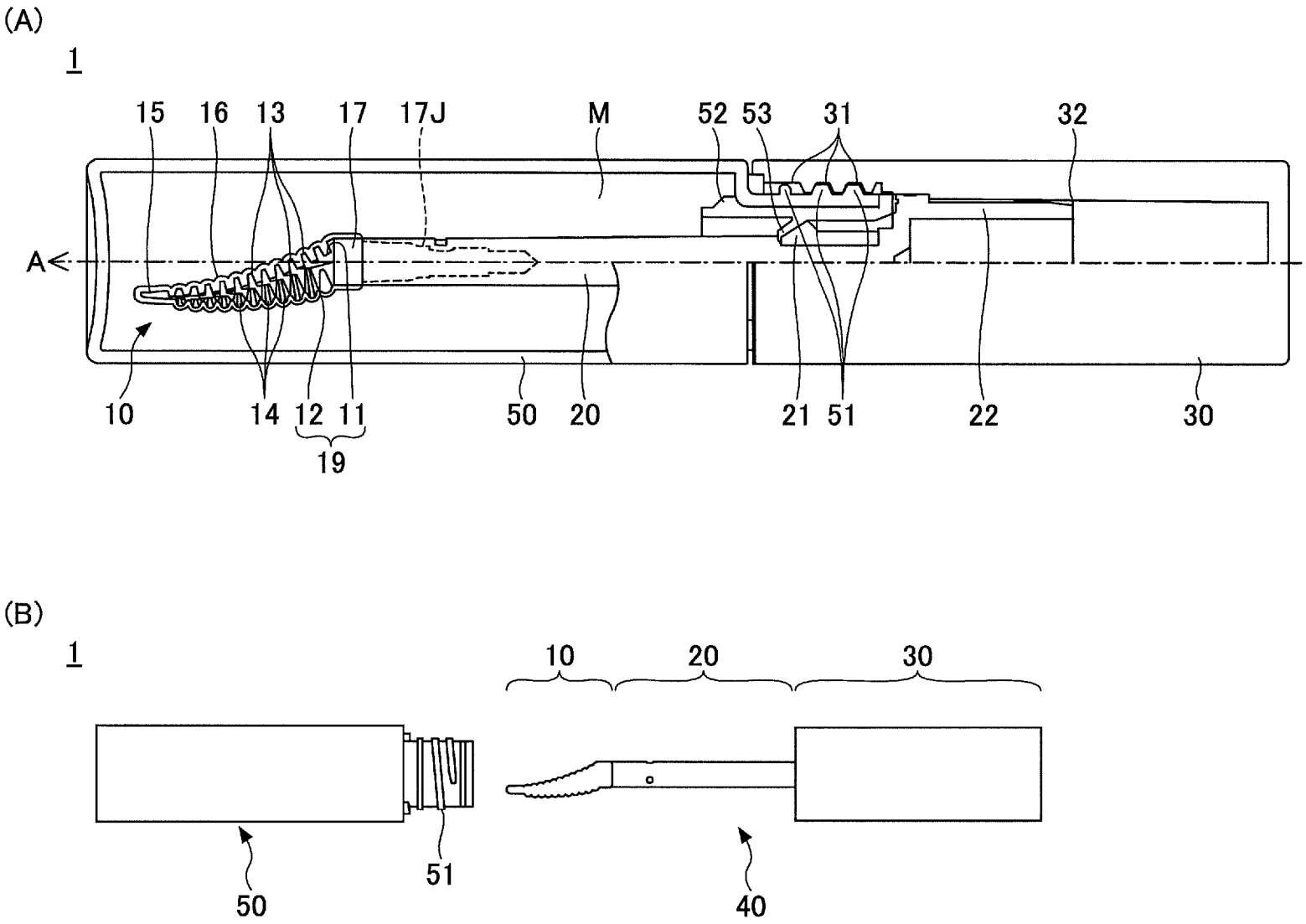
FIG. 1 illustrates a mascara applicator (eye cosmetic applicator) and an eye cosmetic tool in which the mascara applicator is applied, of an embodiment of the invention, wherein (A) is a partial cross-sectional view of a state in which the mascara applicator is attached to a mascara container, and (B) is an elevation view of a state in which the mascara applicator is detached from the mascara container.

FIG. 1 illustrates a mascara applicator (eye cosmetic applicator, applicator) and an eye cosmetic tool that applies the mascara applicator, of an embodiment of the invention. In FIG. 1, (A) is a partial cross-sectional view illustrating a state in which the mascara applicator is attached to a mascara container, and (B) illustrates an outline of a state in which the mascara applicator is detached from the mascara container.

First, with reference to (A) and (B) of FIG. 1, a mascara tool (eye cosmetic tool) 1 is described. The mascara tool 1 includes a mascara applicator 40 and a mascara container 50.

The mascara container (cosmetic container) 50 is a container in which a cosmetic (liquid mascara and the like) M is filled (contained). The cosmetic M of FIG. 1 is not limited to mascara (liquid mascara), and may be an eyelash enhancing agent, a mascara primer, an eyelash coating agent, a coating agent for eyelash extension, liquid eyeliner, a cosmetic that can be used for multiple purposes such as a dual purpose cosmetic composition used as mascara and eyeliner and the like.

The mascara applicator 40 includes an application body 10, a stem (spindle) 20 and a gripping portion 30. The stem 20 is attached to the gripping portion (limb portion, cap portion) 30 having a circular cylinder shape. The application body 10 of liquid mascara is attached at a front end of the stem 20. The application body 10 is described later in detail.

The mascara container 50 is a substantially a tubular body, and an open portion for taking out the cosmetic M is formed. A male screw 51 is formed at the open portion, and a female screw 31 formed at an inner wall of the gripping portion 30 of the mascara applicator 40 is screwed with the male screw 51.

When the mascara container 50 is screwed with the gripping portion 30 as illustrated in (A) of FIG. 1, the application body 10 provided at the stem 20 is soaked in the cosmetic M in the mascara container 50.

A scraping member 52 is provided at the mascara container 50 near the open portion. The scraping member 52 is constituted by an elastic body, and scrapes the mascara that is excessively adhered to the application body 10 by contacting with the application body 10 when detaching the mascara container 50 from the mascara applicator 40. An amount of the mascara adhered to the application body 10 can be appropriately adjusted by the scraping member 52.

A container-side contacting portion 53 is also provided at the mascara container 50 near the open portion. A gripping-side contacting portion 21 is provided at the stem 20. The gripping-side contacting portion 21 has a function to pressing back the cosmetic M that is reserved at the container-side contacting portion 53 into the container.

The stem 20 may be detachable from the gripping portion 30, or may be integrally formed with the gripping portion 30. When the stem 20 is detachable from the gripping portion 30, an engaging portion (protruding portion) 22 detachably engages with an inner wall 32 or an engaging portion (not illustrated) of the gripping portion 30.

Figure 2:
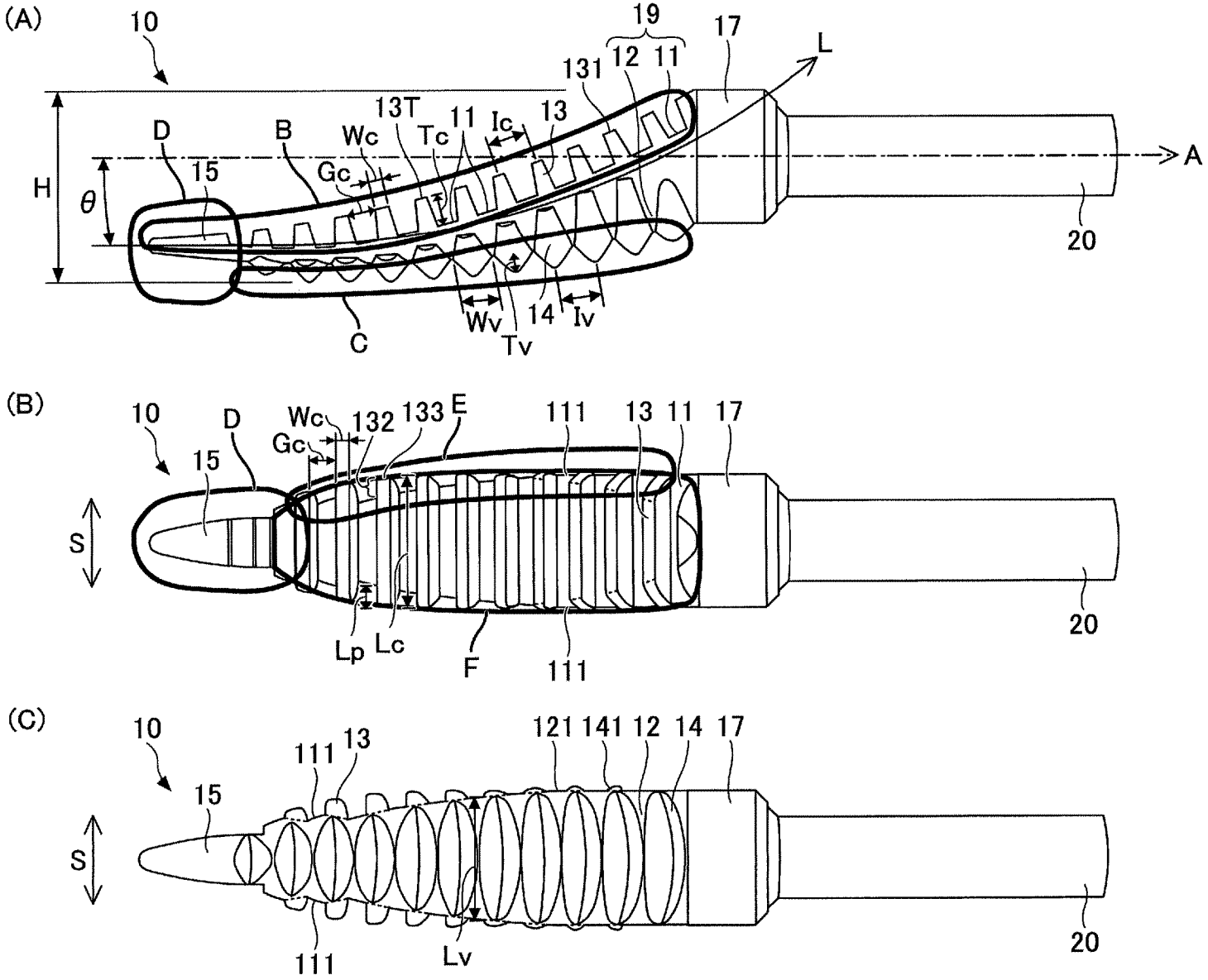
FIG. 2 is an enlarged view of an application body of the mascara applicator of the embodiment, wherein (A) is an elevation view, (B) is a plan view and (C) is a bottom view.
Figure 3:
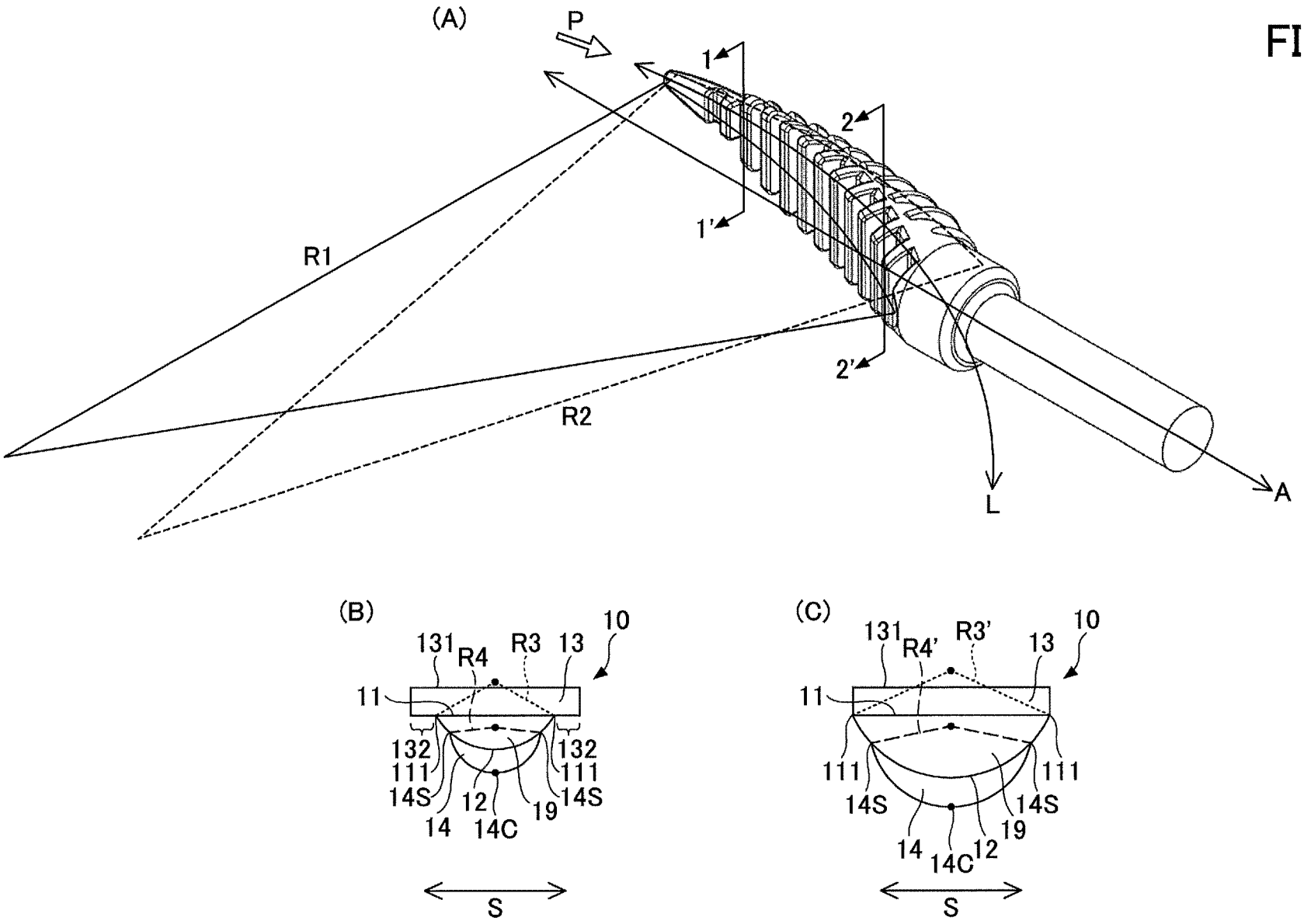
FIG. 3 is an enlarged view for describing the application body of the mascara applicator of the invention, wherein (A) is a perspective view, (B) is a cross-sectional view of (A) along a 1-1' line and (C) is a cross-sectional view of (A) along a 2-2' line.

As illustrated in FIG. 2 and FIG. 3, the application body 10 includes a base portion 19, protrusions 13 and 14 and a supporting portion 17.

The application body 10 may be detachable from the stem 20, or may be integrally formed with the stem 20. When the application body 10 is detachable from the stem 20, the application body 10 is connected to the stem 20 when a connection portion 17J connected to the supporting portion 17 detachably engages with an inner wall or the like of the stem 20.

The base portion 19, the protrusions 13 and 14 and the supporting portion 17 may be configured such that their surfaces are covered by flocking (thin fibers) 16.

(Application Body)

The application body 10 is described in detail with reference to FIG. 2 and FIG. 3.

FIG. 2 and FIG. 3 are enlarged views of the application body 10 of the mascara applicator 40 of the embodiment.

The application body 10 includes the supporting portion 17 connected to a front end of the stem 20, the base portion 19 supported by the supporting portion 17 and the plurality of wall-like protrusions 13 and 14 protruded from the base portion 19. Each of the wall-like protrusions 13 and 14 are prism protrusions each having a rectangular cross-sectional shape or a polygonal cross-sectional shape. Alternatively, the supporting portion 17 may not be provided, and the base portion 19 and the stem 20 may be directly connected.

The application body 10 is formed by integrally molding resin. As a resin material, it is preferable to use thermoplastic resin, and for example, elastomer, polyethylene, polypropylene, polystyrene, polyethylene terephthalate, polybutylene terephthalate, polycarbonate, polyacetate, nylon and the like may be used.

The base portion 19 has a longitudinal elongated shape with a longitudinal direction "L" (curving direction of a center portion of the base portion 19) and a width direction (short direction) "S" that is perpendicular to the longitudinal direction "L", in planar view. The base portion 19 includes a front surface (application surface at a side where the liquid mascara is mainly applied) 11, a back surface (eyelash combing surface) 12 and a needle-shaped front end 15.

The base portion 19 is formed to be gradually becoming thinner (narrower) toward its front end in a height direction "H" and in the width direction "S". The base portion 19 has a substantially plate-like shape including the front surface 11 and the back surface 12 that is positioned to be opposing the front surface 11.

The base portion 19 has an arch shape that is curved to be concaved at a front surface 11 side with respect to an axial direction "A" in which the stem 20 extends. In other words, the front surface 11 is formed as a concaved curved surface (concaved surface). With this, as illustrated in (A) of FIG. 2 and (A) of FIG. 3, the base portion 19 is slightly curved to be concaved at the front surface 11 side in the width direction "S" of the base portion 19.

In (A) of FIG. 2, a portion surrounded by a circle "B" is used for applying mascara from center portions to front end portions of eyelashes, a portion surrounded by a circle "C" is used for combing the eyelashes when applying the mascara, and a portion surrounded by a circle "D" is used for applying eyeliner and separating clumps when applying the mascara. Further, in (B) of FIG. 2, a portion surrounded by a circle "E" is used for applying the mascara to roots and the entirety of the eyelashes.

As can be understood from (A) of FIG. 2, the front end of the base portion 19 that is the furthest from the stem 20 is apart from the axis "A" of the stem 20 that is connected to the base portion 19, and the base portion 19 of the application body 10 is inclined with respect to an extending direction of the axis "A" of the stem 20. As an example, it is preferable that an inclination angle of the base portion 19 with respect to the stem 20 is approximately 5 to 10° (an inclination angle of the base portion 19 with respect to the axis "A" is illustrated by an arrow "θ" in (A) of FIG. 2).

As the base portion 19 of the application body 10 is inclined with respect to the stem 20, when detaching the mascara container 50 from the mascara applicator 40, while the application body 10 passes through the scraping member 52, a large amount of the cosmetic can be adhered to a front side where the front surface 11 and the front surface protrusions 13 are provided, and the cosmetic is scraped at a back side where the back surface 12 and the back surface protrusions 14 are provided. Thus, the front side is appropriate for application, and the back side has a function of combing (separating).

The base portion 19 has an arch shape that is curved to be concaved at the front surface 11 side in the longitudinal direction "L". In other words, the front surface 11 is curved to concave and the back surface 12 is curved to protrude in the longitudinal direction "L". The front surface 11 is positioned inside the concaved and curved base portion 19 (concaved curved surface), and the back surface 12 is positioned outside the protruded and curved base portion 19 (protruded curved surface). As such, a radius of curvature "R1" of the curve of the front surface 11 of the base portion 19 is set to correspond to a curve "R" of an eyelid (a curve of an eye) from which the eyelashes grow (see (A) of FIG. 3 and (A) of FIG. 6).

Further, for the base portion 19, a radius "R2" of the curve of the back surface 12 is larger than the radius "R1" of the curve of the front surface 11 in the longitudinal direction "L". In other words, the curvature of the back surface 12 is small (the curve is moderate) while the curvature of the front surface 11 is large (the curve is sharp) (see (A) of FIG. 3). Thus, a distance (thickness) between the front surface 11 and the back surface 12 in the height direction "H" of the base portion 19 becomes gradually shorter (thinner) as departing from the stem 20. For example, the shape becomes a fang shape as illustrated in the side view of (A) of FIG. 2.

Specifically, it is preferable that a length of the front surface 11 of the base portion 19 in the longitudinal direction "L" is 15 mm to 40 mm, in particular, 16 mm to 28 mm, from viewpoints that the entirety of the eyelashes from an inner corner to an outer corner of an eye can be pressed at once, and also usability.

Further, it is preferable that a length of a widest portion of the base portion 19 in the width direction "S", which is a short direction of the base portion 19, is 3 to 8 mm, in particular, 3.5 mm to 4.5 mm from viewpoints that the entirety of the eyelashes from the roots to the tips can be pressed, and also usability.

Figure 6:
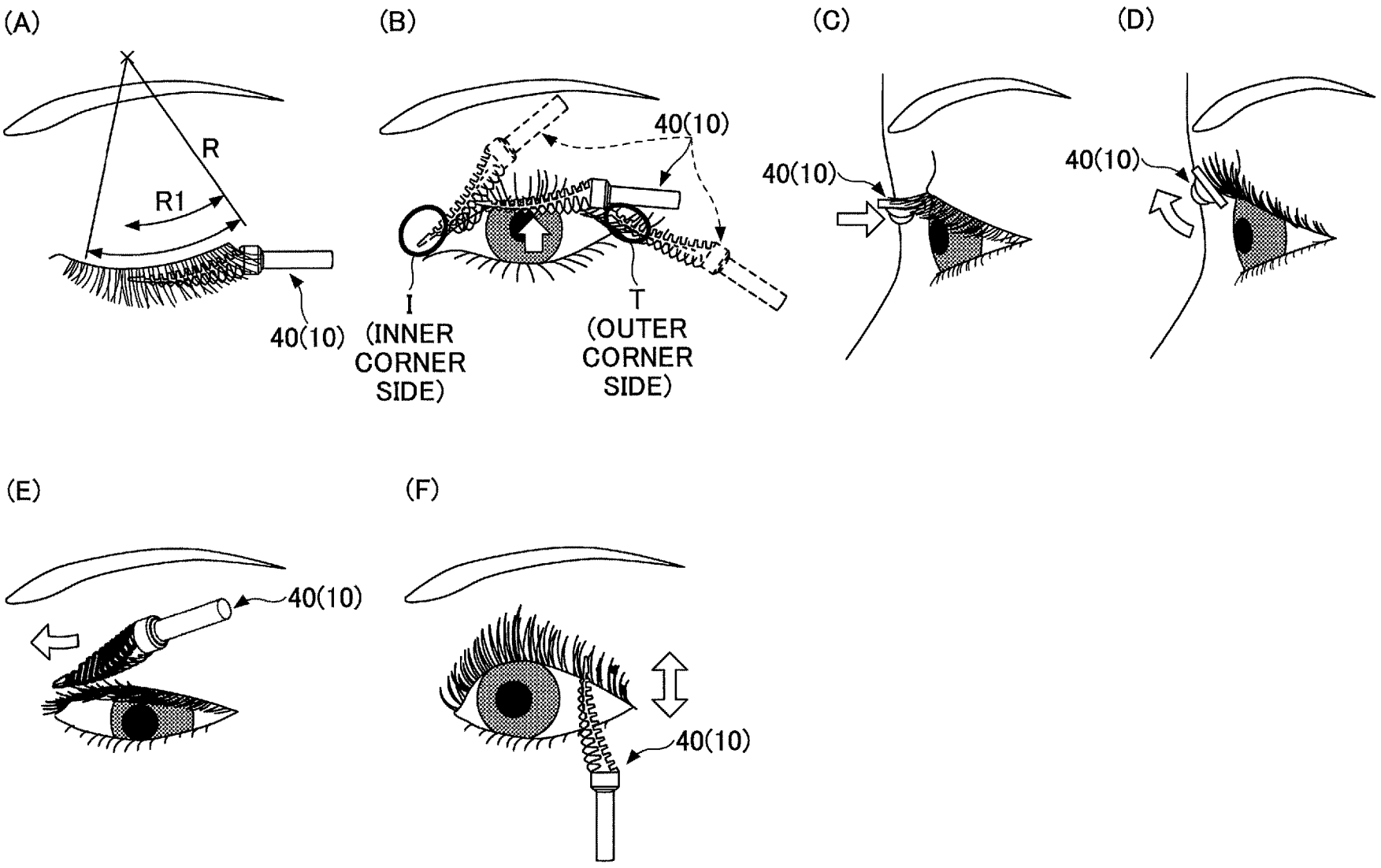
FIG. 6 illustrates examples of applying mascara by the eye cosmetic applicator of the embodiment to upper eyelashes, wherein (A) and (B) are elevation views when applying liquid mascara to roots of eyelashes, (C) is a side view when applying the liquid mascara to the roots of the eyelashes, (D) is a side view when applying the liquid mascara from center portions to front end portions of the eyelashes, (E) is a perspective view when combing the center portions of the eyelashes and (F) is a perspective view when combing the eyelashes near an outer corner of an eye.

It is preferable that a curve (in other words, curvature of the curve) of the front surface 11 of the base portion 19 is, when being expressed by the radius of curvature "R1", greater than or equal to 20 mm, in particular, greater than or equal to 30 mm from a viewpoint that the eyelashes can be surely pressed in accordance with a curve of an eyelid (see (A) of FIG. 6).

It is preferable that a curvature of the curve of the back surface 12 of the base portion 19 along the longitudinal direction "L" is, when being expressed by the radius of curvature "R2", greater than or equal to 30 mm, in particular, greater than or equal to 40 mm from a viewpoint that the back surface 12 contacts the eyelashes by plane to separate (comb) each of the eyelashes.

Here, as illustrated in (B) of FIG. 3 and (C) of FIG. 3, the front surface 11 includes a linear portion at least at a part in a cross-section along a direction substantially perpendicular to the curving direction "A" (the width direction "S", which is a short direction of the base portion). Here, the linear portion in the cross-section may include a slight concaved curve and a slight protruded curve (see FIG. 9, FIG. 10 and FIG. 11).

The back surface 12 of the base portion 19 is slightly curved to protrude outwardly in the width direction "S". It is preferable that radiuses of curvatures "R3" to "R3'" of the curve of the back surface 12 in the width direction ((B) of FIG. 3 and (C) of FIG. 3) are 0.5 mm to 8 mm, in particular, 1.5 mm to 4.0 mm.

In the width direction "S", the radius of curvature "R3'" of the back surface 12 at a portion near the supporting portion 17 ((C) of FIG. 3) and the radius of curvature "R3" of the back surface 12 at a portion near the needle-shaped front end 15 ((B) of FIG. 3) are the same, and is 2.0 mm in this example. Alternatively, the radius of curvature "R3" at the portion near the front end may be smaller than the radius of curvature "R3'" at the portion near the supporting portion 17, and in such a case, the radius of curvature at a widest portion in the width (at the supporting portion 17 side) may be approximately 1.5 mm to 2.5 mm. Further, the portion near the front end may be thinner, and for example, the radius of curvature may be 1.0 mm.

Further, for the example of FIG. 3, it is preferable that a radius of curvature of a front end of the back surface protrusion 14 is 0.7 mm to 2.1 mm. At this time, in the width direction "S", a radius of curvature "R4" (0.7 mm, for example) of the back surface protrusion 14 at the portion near the needle-shaped front end 15 ((B) of FIG. 3) is smaller than a radius of curvature "R4'" (2.0 mm, for example) of the back surface protrusion 14 at the portion near the supporting portion 17 ((C) of FIG. 3). Alternatively, the radius of curvature "R4" of the back surface protrusion 14 at the portion near the front end and the radius of curvature "R4'" at the portion near the supporting portion 17 may be the same.

As can be understood from (B) and (C) of FIG. 2, the base portion 19 has a leaf-like shape of a tree such as a lanceolate shape (bamboo leaf shape) (a portion surrounded by "F") which becomes thinner in the width direction of the base portion 19 as well as departing from the stem 20. Here, the lanceolate shape may include a wide lanceolate shape, a shape in which two sides of a triangle other than a side at the supporting portion 17 are curved to expand outwardly and a triangle.

When having such a shape which becomes thinner, short eyelashes at end portions, an inner corner or an outer corner, of a curve of an eye and the application body 10 are easily contacted, and usability in applying the cosmetic to the inner corner or the outer corner is improved. Here, as illustrated in (B) of FIG. 2 and the like, when forming the needle-shaped front end at the front end of the lanceolate shape, it is preferable to be formed into a frustum shape where the front end of the lanceolate shape is cut-off.

Next, the protrusions (wall-like protrusions 13 and 14) are described.

The plurality of wall-like front surface protrusions (also referred to as "wall-like protrusions" or "protrusions") 13 are provided to stand at the front surface 11 of the base portion 19. Each of the front surface protrusions 13 is a wall-like protrusion that extends substantially over the entirety of the front surface 11 in the width direction. The plurality of front surface protrusions 13 are formed to be substantially in parallel with each other at the front surface 11. By providing the front surface protrusions 13, separation of the liquid mascara at the front surface 11 is improved.

Further, as can be understood from (A) of FIG. 2 and (A) of FIG. 3, according to the embodiment, the wall-like front surface protrusions (wall-like protrusions) 13 protrude from the front surface 11 in a front direction of the front surface 11, in a direction substantially perpendicular to the linear portion in the cross-section.

Thus, the front surface 11 and the front surface protrusions 13 are inclined from the stem 20 and extend in directions different from the stem 20. By being inclined from the stem 20, when applying the liquid mascara to the roots of the eyelashes, contacting to a curved eye can be easily adjusted. Further, the front surface protrusions 13 that are far from the supporting portion 17 are provided to extend further from side edges 111 at the front side in the width direction "S" of the base portion 19.

Further, as illustrated in (A) of FIG. 2, a front end surface (protrusion front end, edge line) 131 of each of the front surface protrusions 13 is a flat surface or a curved surface. Further, as heights of the front surface protrusions 13 protruding from the front surface 11 are substantially the same for the entirety of the front surface protrusions 13, and the plurality of front surface protrusions 13 are aligned, the front end surfaces 131 of the plurality of front surface protrusions 13 are aligned to be curved in a concaved manner in the axial direction "A".

At this time, the front surface protrusion 13 has substantially same widths "Wc" at the root of the protrusion and at the front end surface 131 of the protrusion in the width direction that is perpendicular to the extending direction. Thus, a contact surface with the eyelashes becomes a planar shape, not a sharpened shape, and fear that the application body 10 approaches an eye when applying the mascara can be reduced.

It is preferable that a width "Wc" of the front surface protrusion 13 is greater than or equal to 0.1 mm and less than or equal to 1.5 mm, more preferably, greater than or equal to 0.2 mm and less than or equal to 0.8 mm, and may be 0.5 mm, for example.

It is preferable that a space (distance) "Ic" between the front surface protrusions 13 is greater than or equal to 0.3 mm and less than or equal to 2.0 mm, and may be around 1.2 mm. The value of the space described here expresses a space between highest portions of the front surface protrusions 13.

Further, a step is formed by the side edge 111 and a protruding portion 132 in the width direction "S". As will be described in (B) of FIG. 5, which will be described later, when applying, the cosmetic M can be applied to the eyelashes when the eyelashes enter spaces (gaps), each formed by ""distance Ic"–"width Wc"", between the protrusions (the front surface protrusions 13 with respect to the front surface 11 and the protruding portions 132 with respect to the side edge (outer edge) 111) ("distance Ic"–"width Wc"="gap Gc") (see (A) of FIG. 2).

Thus, as described above, it is preferable that a ratio of the "width Wc" of the contact surface (the front end surface 131 of the front surface protrusion 13 or a side end 133 of the protruding portion 132):the "width Gc" of the gap, is greater than or equal to 1:4 and less than or equal to 1:0.8, in order to reduce the fear and also incorporate the eyelashes between the protrusions.

It is preferable that the height "Tc" of the front surface protrusion 13 is greater than or equal to 0.1 mm and less than or equal to 4.0 mm, more preferably, approximately 0.5 mm to 2.0 mm, and may be approximately 0.9 mm, for example.

More specifically, as illustrated in (C) of FIG. 6, when the application body 10 is moved close to an eye while the front surface 11 is facing upward, "the height "Tc" of the front surface protrusion 13 (see (A) of FIG. 2)×the width "Wc" of the front surface protrusion becomes a contact surface that contacts the eyelashes first.

Thus, in order to remove fear when approaching an eyelid, it is preferable that the contact area (front end area) of the side end (side edge, front end portion) 133 of the protruding portion 132 defined by "the height "Tc" of the front surface protrusion 13×the width "Wc" of the front surface protrusion is greater than or equal to 0.2 $mm^2$ and less than or equal to 2.0 $mm^2$, and may be approximately 0.5 $mm^2$, for example.

It is preferable that the protruding length "Lp" (see (B) of FIG. 2) of the front surface protrusion 13 in the width direction "S" is greater than or equal to 0.1 mm and less than or equal to 2.5 mm, more preferably, greater than or equal to 0.5 mm and less than or equal to 1.8 mm, and furthermore preferably, for example, approximately 1 mm.

It is preferable that the length "Lc" of the front surface protrusion 13 is substantially the same as the base portion 19 in the width direction "S", in particular, approximately 3.0 mm to 8.0 mm at the widest portion, and, in particular, approximately 3.5 mm to 4.5 mm.

More specifically, as illustrated in (D) of FIG. 6, when the application body 10 is moved close to the eye while the front surface is facing the eyelashes, "the length "Lc" of the front surface protrusion 13×the width "Wc" of the front surface protrusion becomes a contact surface that contacts the eyelashes. Thus, in order to remove fear when approaching the eyelid, it is preferable that the contact area (front end area) of the front end surface 131 of the front surface protrusion 13 defined by "the length "Lc" of the front surface protrusion 13 (see (B) of FIG. 2)×the width "Wc" of the front surface protrusion (see (A) of FIG. 2) is greater than or equal to 0.6 $mm^2$ and less than or equal to 6.0 $mm^2$, and may be approximately 2.0 $mm^2$, for example.

As such, the substantially plate-shaped front end surface 131 of the front surface protrusion 13 has a planar shape having the predetermined width "Wc" in the longitudinal direction "L" of the base portion 19, and extends in the width direction "S" of the base portion 19 over the predetermined length (the entire surface of the front surface 11 in FIG. 2) corresponding to the predetermined width "Wc". Further, the adjacent front surface protrusions 13 are aligned at substantially equal intervals, and the front surface 11 exists between the front surface protrusions 13.

With this configuration, when applying the cosmetic, the eyelashes contact the planar-shaped front end surfaces 131 of the front surface protrusions 13 or the front surface 11 by plane. Thus, the eyelashes can be easily brought up, and also fear that the application body 10 approaches the eyeball or the eyelid can be reduced.

Further, as illustrated in (B) of FIG. 2, corner portions of a part of the front end surfaces 131 of the front surface protrusions 13 near the supporting portion 17 may be removed, and the highest portion of each of which may be formed into an ellipse shape. With this configuration, the number of corner portions can be reduced, and the corner portions of the front surface protrusions 13 become difficult to contact the peripheral eyelid when contacting and pressing toward the roots of the eyelashes.

As illustrated in (B) of FIG. 2, the protruding portion 132 of the front surface protrusion 13 provided at the front surface 11 protrudes outside from the side edge (periphery) 111 of the front surface 11. When the protruding portions 132 protrude outside of the side edges 111, when moving the mascara applicator 40 from the roots to the center portions of the eyelashes as will be described later, the eyelashes can be easily combed Here, it is unnecessary for all of the front surface protrusions 13 to include the protruding portions 132, respectively, and at least a part of them may include the protruding portion 132. Further, protruding amounts of the protruding portions 132 from the side edge 111 may be different or the same. For example, in this embodiment, the protruding amount of the protruding portion 132 is larger for the front surface protrusion 13 closer to the needle-shaped front end 15. Thus, in (B) of FIG. 3 which illustrates the cross-section of the portion of the base portion 19 near the front end, the protruding portion 132 of the front surface protrusion 13 is protruded from the side edge 111. However, in (C) of FIG. 3 which illustrates the cross-section of the wider portion of the base portion 19 near the supporting portion 17, the front surface protrusion 13 is not protruded from the side edge 111.

As illustrated in (C) of FIG. 2, the plurality of wall-like back surface protrusions 14 are standing at the back surface 12 of the base portion 19. Each of the back surface protrusions 14 is a wall-like protrusion formed to extend in the width direction of the back surface 12. The back surface protrusions 14 are aligned on a line in the longitudinal direction "L" of the base portion 19.

It is preferable that the highest point of the height "Tv" of the back surface protrusion 14 (see (A) of FIG. 2) is greater than or equal to 0.1 mm and less than or equal to 4.0 mm, and more preferably, approximately 0.7 mm. It is preferable that the width "Wv" of the back surface protrusion 14 is greater than or equal to 0.1 mm and less than or equal to 2.0 mm, and may be approximately 1.2 mm. It is preferable that the widest point of the length "Lv" of the back surface protrusion 14 (see (C) of FIG. 2) is approximately 3.0 mm to 8.0 mm, in particular, approximately 3.5 mm to 4.5 mm. When the back surface protrusion 14 protrudes from the side edge 121 of the back side in the width direction "S" of the base portion 19, the protruding amount is set to be less than or equal to 1.8 mm.

It is preferable that a space (distance) "Iv" between the back surface protrusions 14 is greater than or equal to 0.3 mm and less than or equal to 2.0 mm, and may be around 1.2 mm. The value of the space described here expresses a space between highest portions of the back surface protrusion 14.

The back surface protrusions 14 are aligned over substantially the entire length of the base portion 19 (back surface 12). The back surface protrusions 14 aligned as such are used for combing the eyelashes as illustrated in (E) of FIG. 6. As illustrated in (C) of FIG. 2, protrusion side edges 14S of all of the back surface protrusions 14 are positioned at same positions as side edges 121 of the back surface 12 or inside the side edges 121 of the back surface 12. Alternatively, when the protrusion side edges 14S protrude from the side edges 121 of the back surface 12, respectively, a protruding amount is set to be less than or equal to 1.8 mm.

As illustrated in (B) and (C) of FIG. 3, although the back surface protrusion 14 has a crescent shape where a center portion 14C is high and gradually becomes lower toward side edges in an extending direction (height direction), the highest point may be other than the center, and the shape is not limited.

Figure 5:
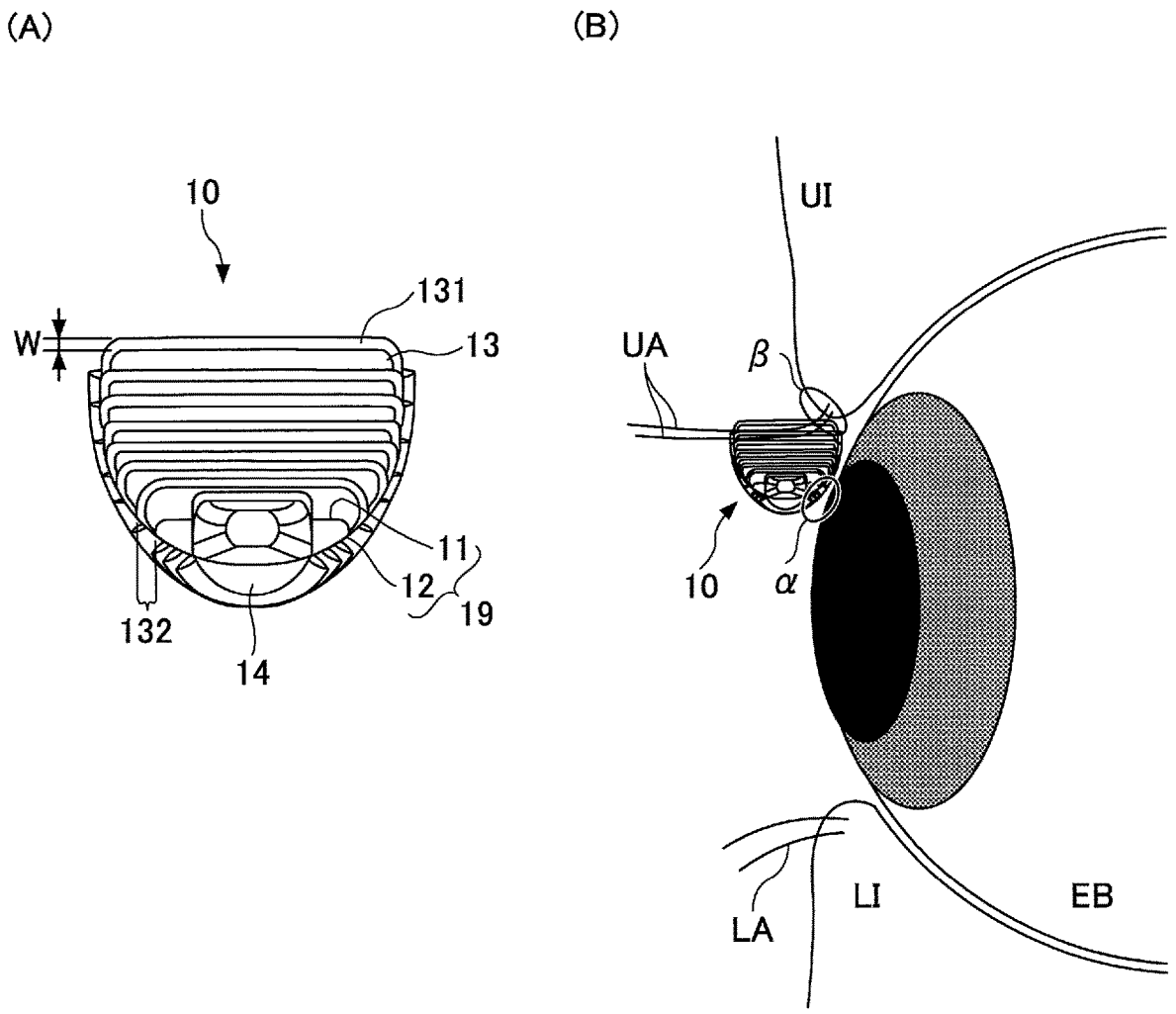
FIG. 5 is a view for describing the application body of mascara of the embodiment, wherein (A) is a view of the mascara of the embodiment seen from the direction "P" in (A) of FIG. 3, and (B) is a view illustrating an eye when making up using the mascara of the embodiment.

With this configuration as well, as illustrated in (B) of FIG. 5, when applying the cosmetic (liquid mascara) M by the application body 10 to the roots of the eyelashes, a portion at the opposite side can be prevented from contacting the eye, and fear of contact can be reduced.

(Positional Relationship Between Eye and Applicator when Making Up Using Configuration of Comparative Example)

Figure 4:
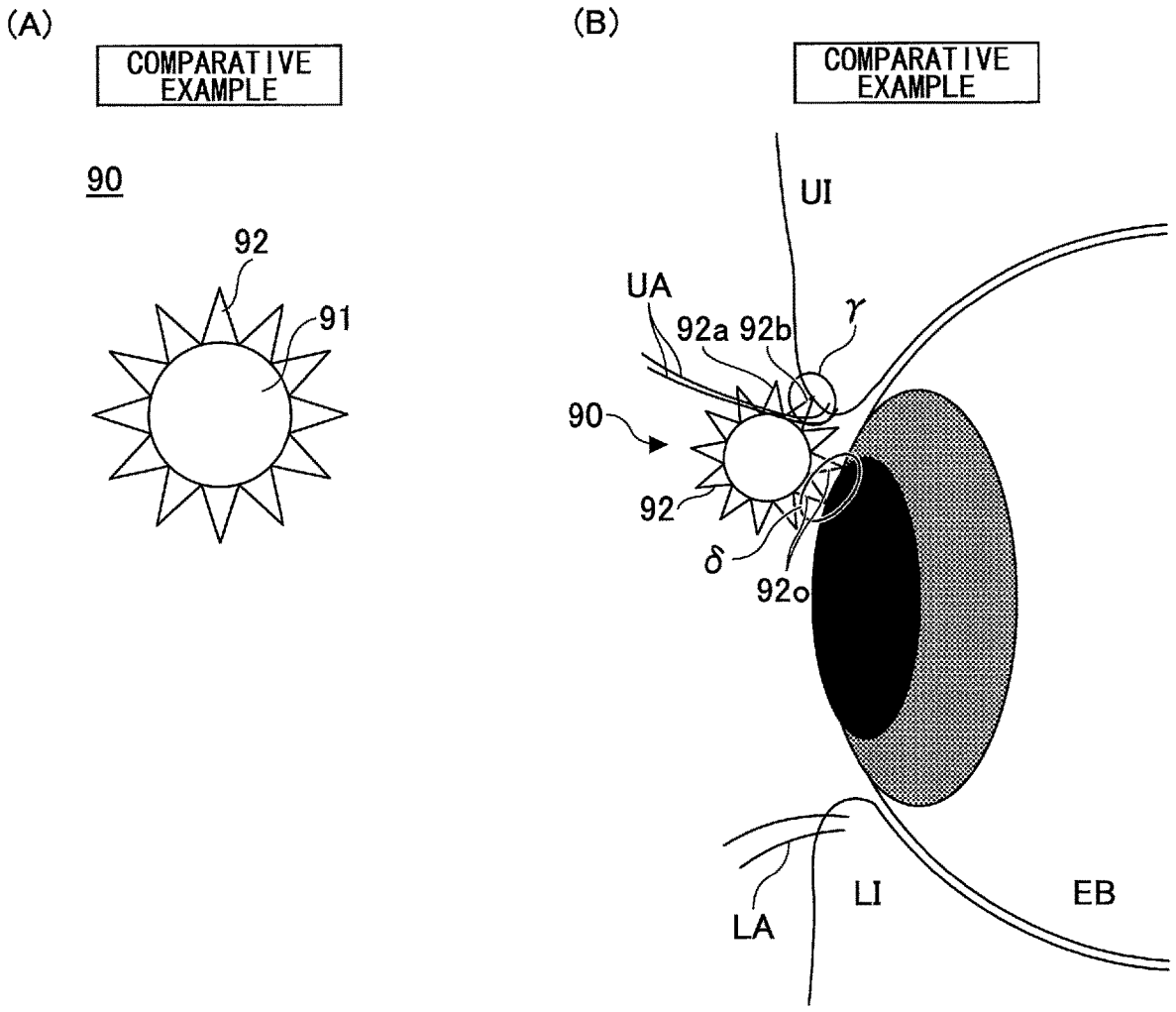
FIG. 4 is a view for describing an application body of mascara of a comparative example, wherein (A) is a view of the mascara of the comparative example seen from a direction "P" in (A) of FIG. 3, and (B) is a view illustrating an eye when making up using the mascara of the comparative example.

(A) of FIG. 4 is a view of a mascara of a comparative example seen from a direction "P" in (A) of FIG. 3, and (B) of FIG. 4 is a schematic cross-sectional view illustrating an eye when making up using the mascara of the comparative example.

When applying mascara as makeup of eyes, it is preferable for a user to look downward, turn her face upward, or bring up or pull an eyelid (upper eyelid UI, lower eyelid LI) by fingers of a hand that does not hold the mascara applicator 40 in order to view the roots of her eyelashes (upper eyelashes UA, lower eyelash LA in the drawing) by a mirror.

As the comparative example, a mascara applicator 90 including an application body that has brushes 92 provided radially with respect to a stem portion 91 is studied.

As illustrated in (A) of FIG. 4, brushes are radially elongated from the stem portion 91, that is provided on a same straight line with a gripping portion 30 held and operated by a user, to which operation force is directly transmitted in the mascara applicator 90. When applying liquid mascara by contacting the brushes 92 to the roots of the eyelashes UA by using the mascara applicator 90, a front end of the brush 92 protruded from the stem portion 91 at a different direction may contact an eyeball, or the front end of the brush may protrude from a gap between the eyelashes UA to contact the eyelid UI.

Specifically, as illustrated in (B) of FIG. 4, when the brushes 92 are radially protruded from the stem portion 91, as illustrated by a circle "γ" in the drawing, brushes 92*o* protruding in the opposite direction with respect to a brush 92*a* for applying to the upper eyelashes UA may contact the eyeball EB. In particular, in the mascara applicator 90 that includes the conical brushes 92 each of which is tapered toward a front end, as a contact portion at the front end of the brush 92 has a point shape, a user tends to strongly feel fear of contact to the eyeball EB.

Further, if the mascara applicator 90 is moved too close to the eyelid UI, as illustrated by a circle "δ" in the drawing, a front end of the brush 92*b* that is adjacent to the brush 92*a* for applying to the eyelashes UA may contact the eyelid UI. Further, if the liquid mascara is adhered to an undesired portion of the eyelid UI by the contact, it is necessary to remove the adhesion.

As such, when the user makes up using the mascara applicator 90 of the comparative example, there are risks (fears) of contact of the brush 92*o* at the opposite side from the applying side and contact of the brush 92*b* adjacent to the applying side to the eyelid UI, and further there is an annoyance to remove an adhesion when a cosmetic adheres an undesired portion of the eyelid UI. Therefore, a user tends to hesitate to apply the mascara to the roots of the eyelashes UA.

On the other hand, according to the eye cosmetic applicator of the invention, the above problems can be solved.

(Positional Relationship Between Eye and Applicator when Making Up Using Configuration of Invention)

(A) of FIG. 5 is a view of the mascara applicator 40 of the embodiment of the invention seen from the direction "P" in (A) of FIG. 3, and (B) of FIG. 5 is a schematic cross-sectional view illustrating an eye when making up using the mascara applicator 40 of the embodiment.

When using the mascara applicator 40 of the embodiment, when applying the liquid mascara by the front surface protrusions 13 and the protruding portions 132 from the side edge to roots of eyelashes UA while facing the front surface 11 upward, the opposite back surface 12 approaches an eyeball EB.

As described above, the back surface protrusions 14 of the back surface 12 has a crescent shape (substantially crescent shape) where the center portion 14C protrudes the highest and gradually becomes lower toward the protrusion side edges 14S. Further, the protrusion side edges 14S of the back surface protrusions 14 are positioned at the same positions as the side edges 121 of the back surface 12 or inside the side edges 121 of the back surface 12 (see (A) of FIG. 5). Alternatively, when the protrusion side edges 14S protrude from the side edges 121 of the back side, the protruding amount is set to be less than or equal to 1.8 mm.

Thus, as illustrated in (B) of FIG. 5, the back surface protrusions 14 do not protrude from the base portion 19 at a position of a circle "α" in the drawing in an opposite direction from the front surface protrusions 13 of the front surface 11 for applying to the eyelashes UA, and a risk that the application body 10 contacts the eyeball EB can be reduced.

Further, as the front end surfaces 131 of the front surface protrusions 13 are aligned to be curved substantially analogous to the front surface 11 and substantially in parallel to the front surface 11, the front end surfaces 131 are easily fit along the curves of the eyelashes UA (curled eyelashes).

Thus, it is easy to adjust the front surface protrusions 13 not to contact the eyelid UI at a position of a circle "β" in (B) of FIG. 5.

Further, according to the structure of the invention, as the protruding portions 132 from the side edges of the front surface protrusions 13 are short (less than or equal to 1.8 mm, for example), when the protruding portions 132 enter spaces between the roots of the eyelashes UA, it is difficult for the protruding portions 132 to contact the eyelid UI.

In this embodiment, it is preferable that a front end surface (side end standing surface) of the protruding portion 132 corresponds to the height of the protrusion 13 from the front surface 11, and has a predetermined width (greater than or equal to 0.1 mm and less than or equal to 1.5 mm, more preferably, greater than or equal to 0.2 mm and less than or equal to 0.8 mm, and approximately 0.5 mm, for example). By having such a width, the front end of the protrusion 13 is not sharpened, and a fear in approaching the eyelid UI can be reduced.

With this, when applying the cosmetic M by the mascara applicator of the embodiment to the roots of the eyelashes (upper eyelashes UA, lower eyelashes LA), as fear of contacting to the eyeball EB or the eyelid (upper eyelid UI, lower eyelid LI) is lowered, a user can surely apply the mascara to the roots of the eyelashes.

(Using Example)

FIG. 6 illustrates examples of applying mascara by the eye cosmetic tool of the embodiment of the invention to upper eyelashes. (A) and (B) of FIG. 6 are elevation views when applying the liquid mascara to the roots of the eyelashes.

(C) of FIG. 6 is a side view when applying the liquid mascara to the roots of the eyelashes, and (D) of FIG. 6 is a side view when applying the liquid mascara from center portions to front end portions of the eyelashes. Here, in (C) and (D) of FIG. 6, although side views are illustrated for the eye of the user, cross-sectional views of the mascara applicator 40 are illustrated in order to describe its function. When performing the applying operation illustrated in (A) to (D) of FIG. 6, the front side (front surface 11, front surface protrusions 13) and the side edge side (side edge 111 (121), protruding portions 132) of the base portion 19 are used.

(E) of FIG. 6 is a perspective view when combing a center portion of the eyelashes, and (F) of FIG. 6 is a perspective view when combing the eyelashes near an outer corner of the eye.

First, when applying the liquid mascara to the roots of the eyelashes, as illustrated in (A) of FIG. 6, the front surface 11 is positioned (inserted) to the eye (front direction) so that the curve "R" of the front surface 11 corresponds to the curve "R" of the eye. At this time, as illustrated in (C) of FIG. 6, the mascara applicator 40 contacts the roots of the eyelashes while the protruding portions 132 contact the eyelashes at the side surface such as to comb and separate the eyelashes.

As illustrated in the elevation view of (B) of FIG. 6 and the side view of (C) of FIG. 6 when starting to contact the mascara applicator 40 to the roots of the eyelashes, the protruding portions 132 contact the roots of the eyelashes while combing (separating) the eyelashes by the steps by the protruding portions 132 and the side edge 111. At this time, the roots of the eyelashes contact the protruding portions 132 or the side edge 111.

As illustrated in (B) and (C) of FIG. 6, there is an advantage for an example of using while facing the front side upward ((B) of FIG. 6) that it is easy to move to the next applying operation. However, when starting the application, as long as the steps formed by the protruding portions 132 and the respective side edge 111 contact the roots of the eyelashes, either of the side edges can be used. Thus, both examples of using while facing the front side toward the eyeball and using while facing the front side downward may be used.

Here, according to the embodiment, as can be understood from (C) of FIG. 6, as the protrusions 13 and 14 are not protruding toward the eyeball, fear that the mascara applicator 40 contact the eyeball can be suppressed.

Further, as illustrated in (C) of FIG. 6, as the protruding portions 132 have shapes (lengths) that can easily enter the roots of the eyelashes, the cosmetic can be firmly applied from the roots of the eyelashes. Here, the protruding portions 132 are pressed to contact the roots of the eyelashes under the state of (B) and (C) of FIG. 6 in which the protruding portions 132 enter between the roots of the eyelashes to contact. Then, by keeping this pressing and contacting state for a predetermined period, the roots of the eyelashes can face upward.

Thereafter, in order to apply the liquid mascara to the center portions to the front end portions of the eyelashes, as illustrated in (D) of FIG. 6, the mascara applicator 40 is moved upward with respect to the eyelashes while having the front side (front surface 11, front surface protrusions 13) of the application body 10 contacting and pressing toward the eyelashes.

Here, the front end surface 131 of the front surface protrusion 13 has a planar shape, a flat surface or a curved surface (concaved, protruded), and grooves at spaces between the adjacent front surface protrusions 13 that are aligned at substantially equal intervals are the front surface 11, the eyelashes and the mascara applicator 40 contact by plane in a direction same as extending direction of the eyelashes at the state of (D) of FIG. 6. Thus, the eyelashes can be beautifully curled, and good finishing can be obtained.

Further, as illustrated in (A) of FIG. 6, the radius of curvature "R1" of the front surface 11 of the base portion 19 substantially matches the curve "R" of the eyelid (radius of curvature of the curved shape), and the front surface 11 extends by matching at least a part of the curved shape. The front end surfaces 131 of the front surface protrusions 13 are aligned in the longitudinal direction "L" to be curved in a concaved manner while matching at least a part of the curved shape of the eyelid. Thus, as the eyelashes can be pressed over a wide range from the inner corner to the outer corner of the eye, the number of pressing time can be once, or a minimum time.

As such, when applying the liquid mascara to the eyelashes, as the eyelashes are short at the inner corner or the outer corner of the eye, that are end portions of the curve of the eye, if the mascara applicator 40 is thick, it is hard to contact. Thus, when applying the liquid mascara to the inner corner or the outer corner, it is preferable to have a thin portion of the application body 10 of the mascara applicator 40 contact the inner corner or the outer corner. In this embodiment, as the base portion 19 is tapered in the height direction "H" and in the width direction "S" (see (B) of FIG. 2) toward the needle-shaped front end 15 of the application body 10, by using the front end portion of the application body 10 of the mascara applicator 40, as the inner corner side (I) or the outer corner side (T) of (B) of FIG. 6, the cosmetic can be easily applied to the short eyelashes at the inner corner side or the outer corner side, and usability is improved.

As described above, the liquid mascara is applied to the eyelashes by the applying operation by angles from (C) to (D) of FIG. 6 when seen from the side surface with relative positions of (A) to (B) of FIG. 6 to the eye (at front). Here, if necessary, the above applying operation may be repeated until the desired amount of the liquid mascara is applied to the eyelashes.

Here, a plurality of the eyelashes to which the liquid mascara is applied may be bundled due to the viscosity of the liquid mascara. Thus, an operation to separate each of the bundled eyelashes is performed next.

As illustrated in (E) of FIG. 6, by flipping the front side and the back side of the mascara applicator 40 upside down, the back surface 12 of the base portion 19 is moved close to the eye. Then, the eyelashes are combed from the roots to the front ends by the back surface protrusions 14 provided at the back surface 12. The eyelashes are guided to groove portions formed between the back surface protrusions 14 of the back surface 12 and combed by the back surface protrusions 14 (separation effect). Here, although an example in which the eyelashes are combed from an upper side by using the back surface 12 and the back surface protrusions 14 is illustrated in (E) of FIG. 6, the eyelashes may be combed from a lower side by using the back surface 12 and the back surface protrusions 14.

Here, when the application body 10 is inclined with respect to the stem as described above, when detaching the mascara applicator 40 from the mascara container 50, although the adhered cosmetic remains at the front side (front surface 11, front surface protrusions 13) the cosmetic is scraped from the back side (back surface 12, back surface protrusions 14) in the base portion 19 when the application body 10 passes through the scraping member 52 (see (A) of FIG. 1). Further, as the back surface 12 is a protruding surface, when passing through the scraping member 52 after being impregnated in the liquid mascara, it is difficult for the liquid mascara to remain at the back surface 12 or at the back surface protrusions 14. Thus, as illustrated in (E) of FIG. 6, when combing the eyelashes by the back surface 12 and the back surface protrusions 14, generation of additional clumps can be prevented.

By repeating the cosmetic application by the protruding portions 132 and the front surface protrusions 13 of the front surface 11 and the operation of separating the bundled eyelashes by the back surface 12 and the back surface protrusions 14 for desired times, a desired finish can be obtained.

Even when the bundle of eyelashes are not released by the operation illustrated in (E) of FIG. 6, for example, the bundle may not be released near the inner corner or the outer corner, at ends of a curve, due to the structure of the eye, it is possible to separate the bundled eyelashes by a method of (F) of FIG. 6.

In (F) of FIG. 6, when combing the eyelashes near the outer corner, by combing and separating the clump by the tapered needle-shaped front end 15, which is the front end of the base portion 19, or the protruding portions 132 near the front end, the bundled eyelashes are separated.

As such, according to the embodiment, by properly using various surfaces of the application body 10, the entirety of the eyelashes are curled by raising the eyelashes from the roots to give volume, and prevent clumps or unevenness to actualize good finishing. Thus, by applying the mascara by the mascara applicator of the invention, a user may not afraid even when contacting the roots of the eyelashes, and also a makeup effect can be obtained.

Figure 7:
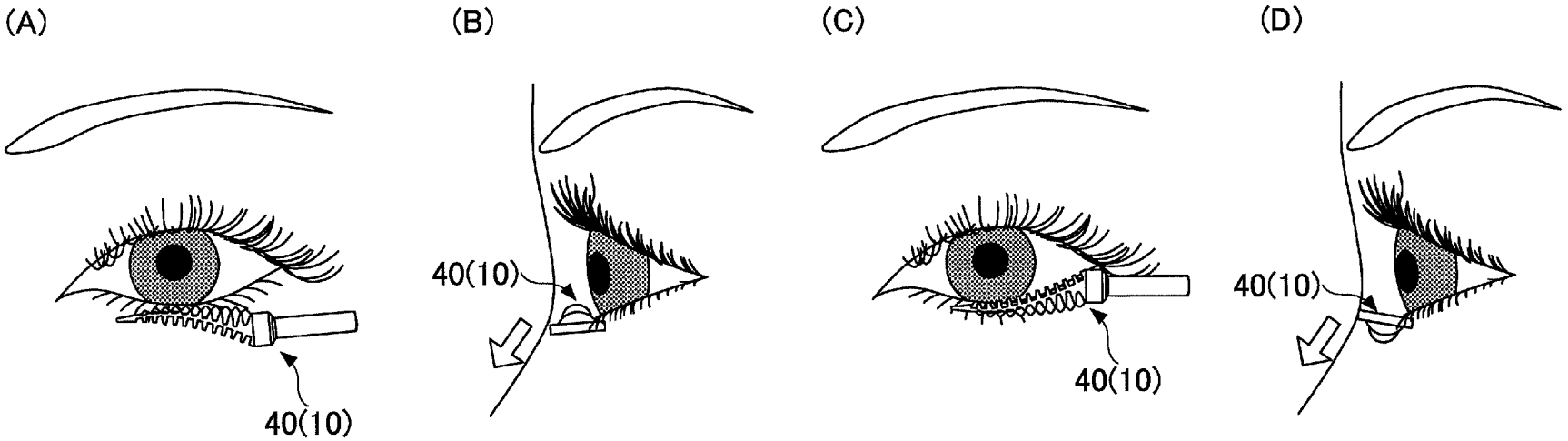
FIG. 7 illustrates examples of applying mascara by the eye cosmetic applicator of the embodiment to lower eyelashes, wherein (A) is an elevation view of an example of applying when a back side faces upward, (B) is a side view corresponding to (A), (C) is an elevation view of an example of applying when a front side faces upward and (D) is a side view corresponding to (C)

Further, the cosmetic may be applied to the lower eyelashes by using the eye cosmetic applicator of the invention. (A) to (D) of FIG. 7 are examples in which mascara is applied by the eye cosmetic applicator of the embodiment to the lower eyelashes. (A) of FIG. 7 is an elevation view of an example in which the back side faces upward, and (B) is a side view corresponding to (A). (C) of FIG. 7 is an elevation view of an example in which the front side faces upward, and (D) is a side view corresponding to (C).

As can be understood from cross-sectional views illustrated in (B) and (D) of FIG. 7, in either cases, the steps of the side surface (protruding portions 132 at the side edge and the side edge 111 (121)) are contacted with the roots of the eyelashes, and applied by combing toward tips. Thus, the mascara can be uniformly applied to the lower eyelashes by combing the eyelashes without generating clumps.

Alternatively, the mascara may be applied to the lower eyelashes by using the needle-shaped front end 15 of the application body 10 in a direction of (F) of FIG. 6.

In the eye cosmetic applicator of the invention, the cosmetic (liquid) that is applied as illustrated in FIG. 6 and FIG. 7 is not limited for applying the mascara, and may be an eyelash enhancing agent, a mascara primer, a coating agent for eyelash extension, an essence for eyelash extension and the like, for example.

Figure 8:
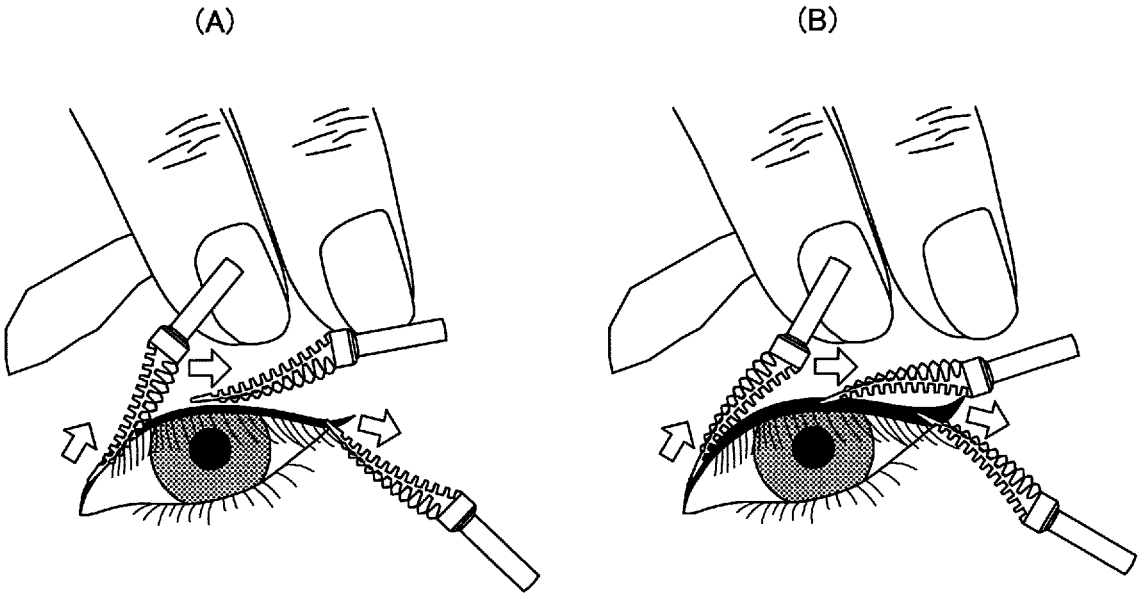
FIG. 8 illustrates an example of the eye cosmetic applicator of the embodiment used for eyeliner, wherein (A) is an elevation view of a case when applying thin eyeliner and (B) is an elevation view of a case when applying thick eyeliner.

Further, the eye cosmetic applicator of the invention may be used as eyeliner as well. FIG. 8 illustrates an example of the eye cosmetic applicator of the embodiment of the invention used for eyeliner, wherein (A) of FIG. 8 is an elevation view of a case when applying thin apply eyeliner, and (B) of FIG. 8 is an elevation view of a case when applying thick eyeliner.

As illustrated in (A) and (B) of FIG. 8, when using the eyeliner, the eyeliner may be applied (drawn) by contacting the needle-shaped front end 15 of the mascara applicator 40 or by contacting the protruding portions 132 of the front surface protrusions 13 extending from the side edge 111, at an edge portion of an eye.

Here, when applying the eyeliner, a user may partially open the eyelid by bringing up the eyelid by fingers, pulling the eyelid in a lateral direction, or looking downward in order to view the roots of the eyelashes by a mirror, and to easily apply the eyeliner.

Although beautiful finishing can be obtained by separating an area of the eyelid to apply the eyeliner to an outer corner portion, a center portion and an inner corner portion, and applying the eyeliner in this order (in each of the portions, a line is drawn by moving a hand from an inner corner to an outer corner), the method of using is not limited to this.

Here, by considering a purpose for the eyeliner, it is preferable that flocking 16 (flocking finishing (electrostatic flocking at a surface)) is applied at least at the front end portion (needle-shaped front end 15) of the eye cosmetic applicator of the invention from a viewpoint of feeling.

(Modified Examples of Base Portion)

Figure 9:
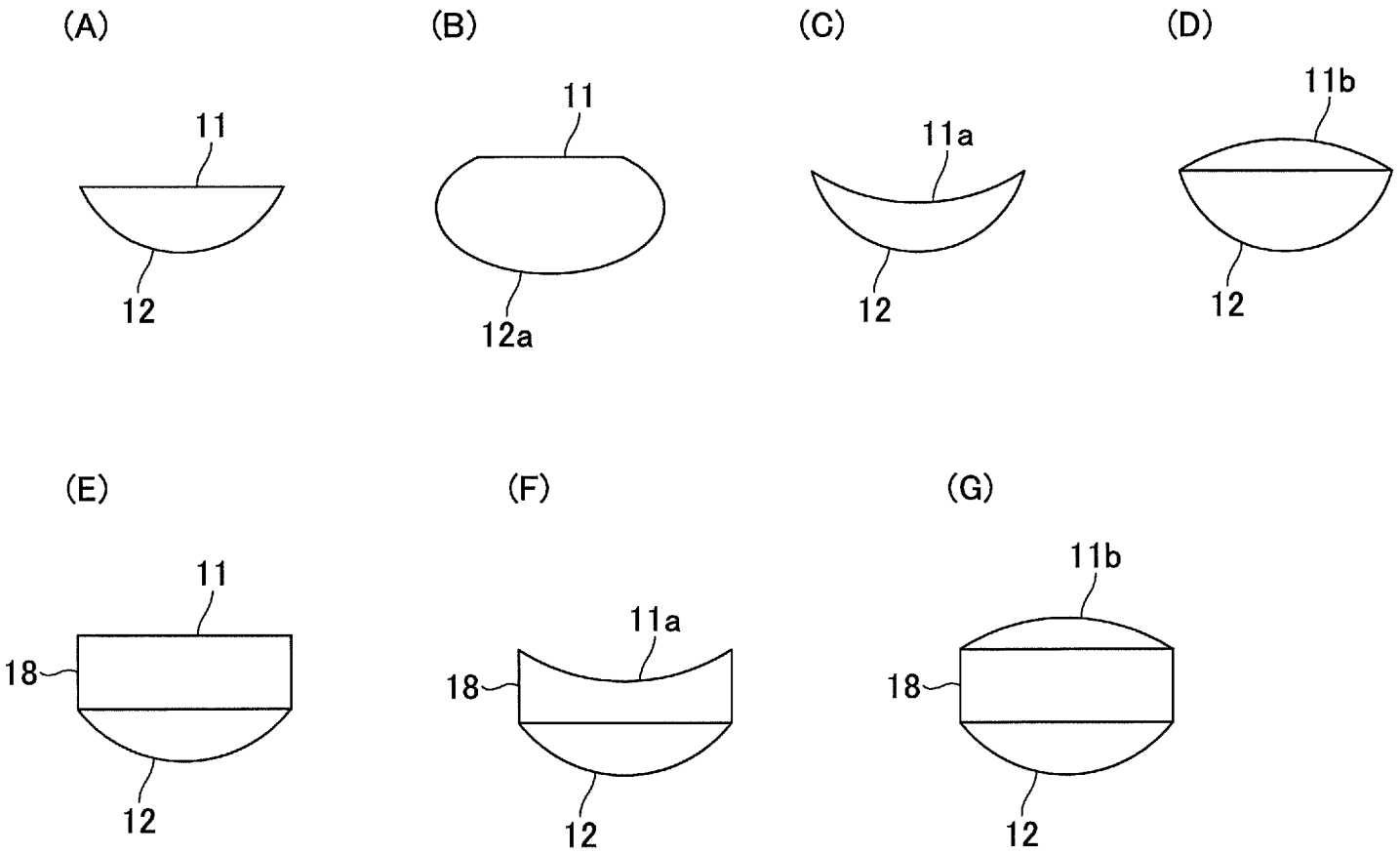
FIG. 9 is a cross-sectional view of a plurality of modified examples of a base portion of the invention.

FIG. 9 illustrates cross-sectional views of a plurality of modified examples of the base portion 19 of the invention.

FIG. 9 illustrates a plurality of modified examples of the base portion 19 where the protrusions 13 and 14 are removed. In the above embodiment, as illustrated in (A) of FIG. 9, the front surface 11 is a flat surface and the back surface 12 is curved to protrude outwardly in the base portion 19 at a cross-section cut in the width direction. However, the shape of the base portion 19 is not limited to this, and various examples may be used.

For example, as illustrated in (B) to (D) of FIG. 9, shapes of surfaces may be different. In (B) of FIG. 9, the curve of a back surface 12*a* is larger than that in (A) of FIG. 9. In (C) of FIG. 9, a front surface 11*a* is curved to concave. At this time a curvature of the concaved portion is larger at the back surface than at the front side. In (D) of FIG. 9, a front surface 11*b* is formed to have a curved shape protruding outwardly.

Further, as illustrated in (E) to (G) of FIG. 9, side surfaces 18 may be provided between the front surface 11 and the back surface 12. In such a case as well, similarly as (A) to (D) of FIG. 9, the shapes of the surfaces may be appropriately varied. For example, as illustrated in (F) of FIG. 9, the front surface 11*a* may be slightly curved to concave. As illustrated in (G) of FIG. 9, the front surface 11*b* may be slightly concaved to protrude.

In any examples, in order to avoid fear of contacting of the application body 10 to an eyeball, it is preferable that the back surface 12 is a curved surface that is protruding outwardly.

(Modified Examples of Protrusions)

Figure 10:
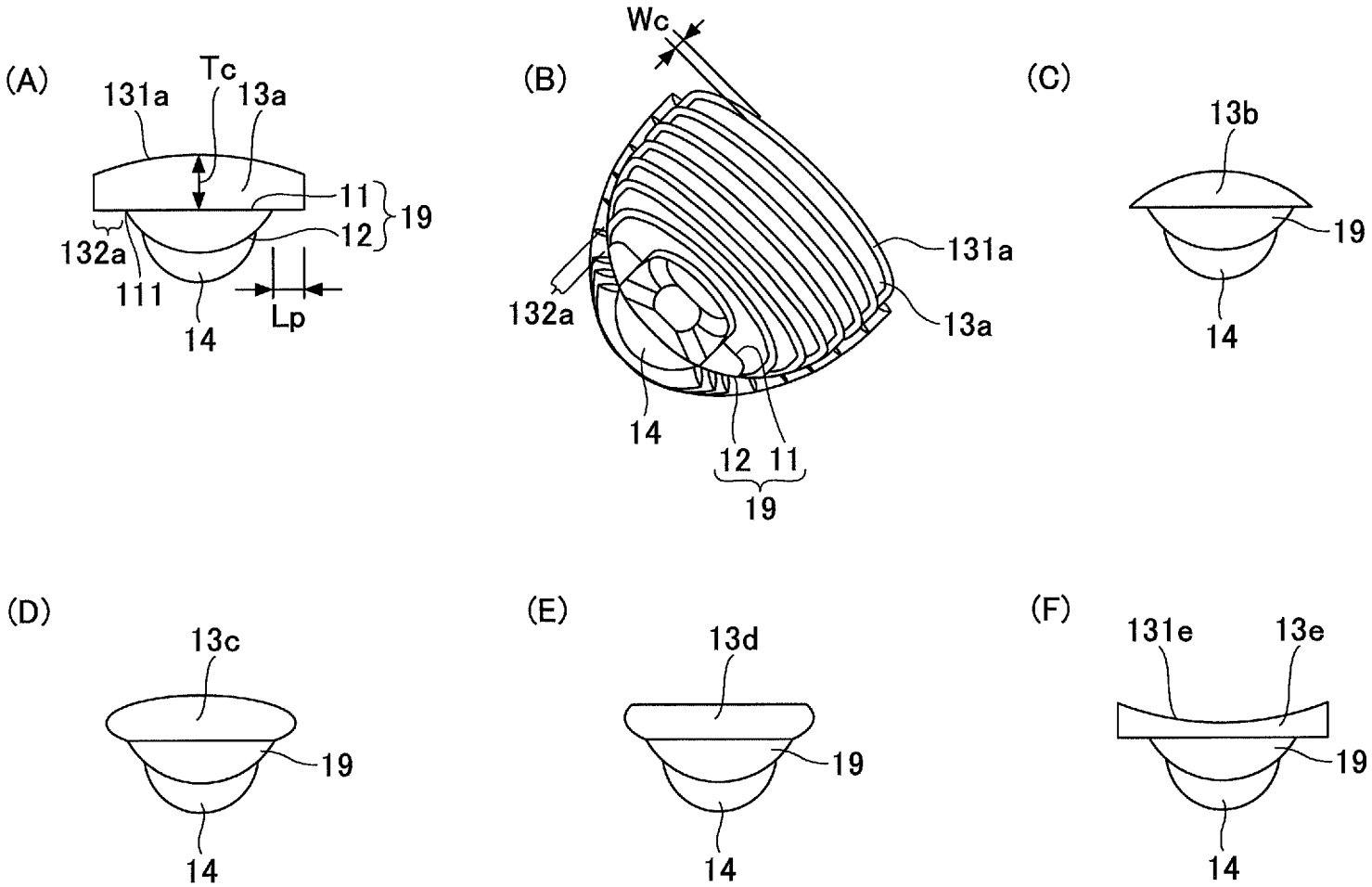
FIG. 10 is a cross-sectional view of a plurality of modified examples of a front surface protrusion of the invention.

FIG. 10 illustrates a plurality of modified examples of the front surface protrusions of the invention. (A) and (C) to (F) of FIG. 10 are cross-sectional views of the mascara applicator 40 (application body 10), and (B) of FIG. 10 is a view of the application body 10 in (A) of FIG. 10 seen from the direction "P" in (A) of FIG. 3 (seen from an oblique upper side).

As illustrated in (B) and (C) of FIG. 3, the front end surface (edge line) 131 of the front surface protrusion 13 is described as a flat surface in the above embodiment. However, the shape of the front surface protrusion is not limited to the flat surface, and the front end surface 131 may be formed into various shapes such as a curved surface.

For example, as illustrated in (A) of FIG. 10, a front end surface 131*a* of a front surface protrusion 13*a* may be a protruded curved surface. Even when the front end surface 131*a* of the front surface protrusion 13*a* is the curved surface, similarly as that described in the above embodiment, the height "Tc" and the length of the protruding portion 132*a*, protruded from the base portion 19, are short, it is difficult for the front surface protrusion 13*a* to contact the eyelid.

Further, (B) of FIG. 10 is a perspective view of the structure of (A) of FIG. 10 (the back surface protrusion 14 is illustrated slightly largely in (B) of FIG. 10). Even when the front end surface 131*a* is curved in the front surface protrusion 13*a*, the root of the protrusion and the front end surface 131*a* of the protrusion has substantially the same width "Wc" in the width direction. Thus, a contact surface with the eyelashes becomes a curved plane surface, not a sharpened shape, fear that the application body 10 approaches an eye when applying the mascara can be reduced.

Further, as illustrated in (C) of FIG. 10, the entirety of a front surface protrusion 13*b* in the width direction may be a protruded curved surface (substantially semi-ellipse shape). Further, as illustrated in (D) of FIG. 10, the entirety of a front surface protrusion 13*c* may have a shape in which a part of an ellipse shape is cut and the cut surface is connected to the front surface 11.

Alternatively, as illustrated in (E) of FIG. 10, curved surfaces may be formed only at side surfaces of a front surface protrusion 13*d*. Further, as illustrated in (F) of FIG. 10, a front end surface 131*e* of a front surface protrusion 13*e* may be a concaved curved surface.

In any structures, as the height "Tc" of the front surface protrusion 13 (13*a*, 13*b*, 13*c*, 13*d* or 13*e*), which is a protruding length from the base portion 19 toward a front surface direction, is short, and the length "Lp" of the protruding portion 132 in an extending direction toward a side edge direction is short, it is difficult for the front surface protrusions 13 to contact the eyelid.

Figure 11:
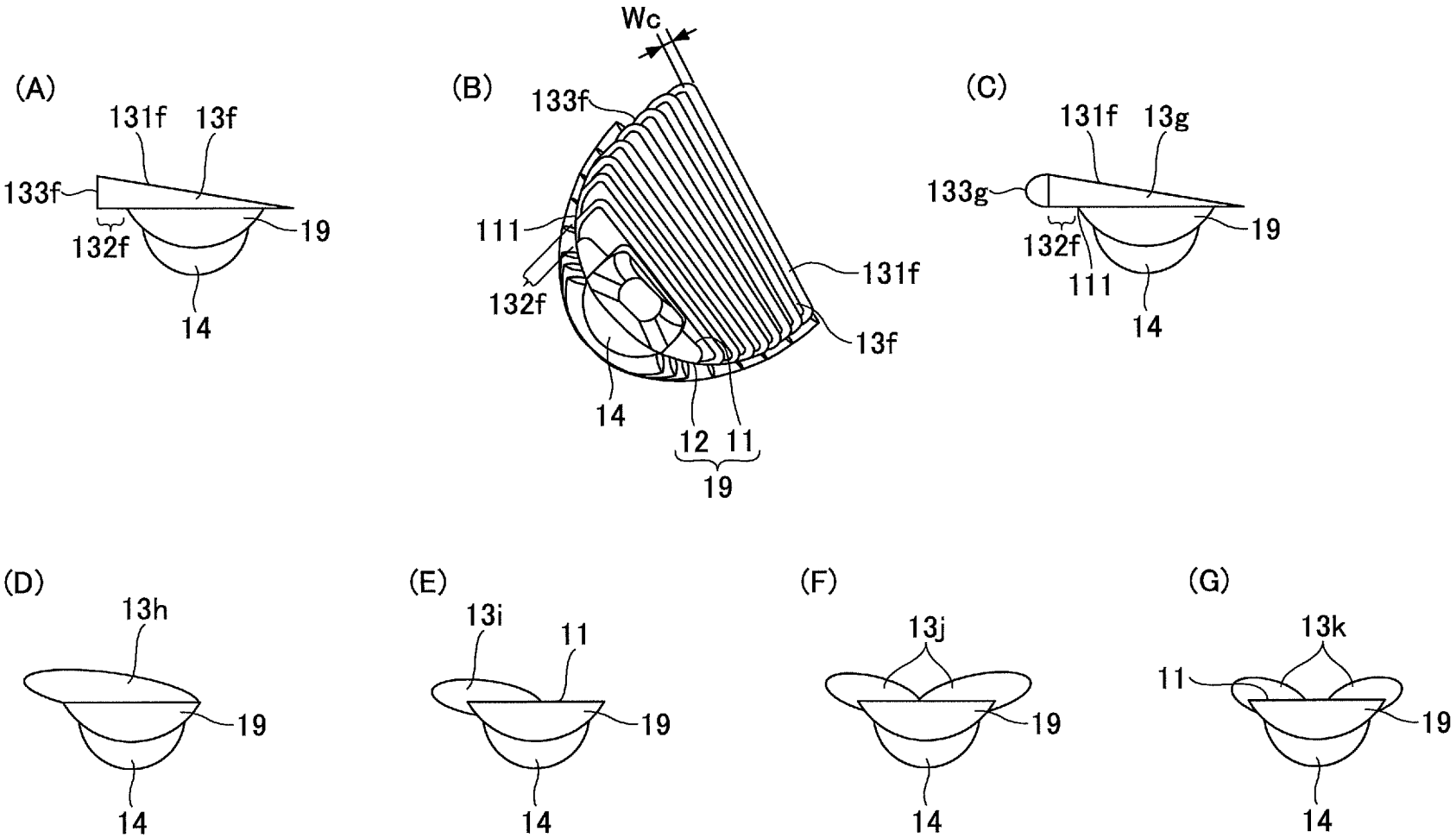
FIG. 11 is a cross-sectional view of a plurality of modified examples of the front surface protrusion of the invention.

FIG. 11 further illustrates a plurality of modified examples of the front surface protrusions of the invention. The shape of the protrusion in the modified examples illustrated in FIG. 10 has a bilateral symmetrical shape. However, as illustrated in FIG. 11, the shape of the protrusion is not limited to the bilateral symmetrical shape, and various examples may be used. (A) and (C) to (G) of FIG. 11 are cross-sectional views of the mascara applicator 40 (application body 10), and (B) of FIG. 11 is a view seen from the direction "P" in (A) of FIG. 3.

A front surface protrusion (wall-like protrusion) 13*f* protruding from the front surface 11 illustrated in (A) of FIG. 11 is formed such that the height is gradually changed in an extending direction. Thus, a front end surface (upper surface) 131*f* of the front surface protrusion 13*f* is an inclined surface. Further, one end (side surface) 133*f* of the front surface protrusion 13*f* is a flat surface.

Further, in an example illustrated in (B) of FIG. 11, although one end 133*f* of each front surface protrusion 13*f* protrudes from the side edge 111 of the front surface 11, the other end is flush with the side edge 111 of the front surface 11 and is not protruded. Further, distances between adjacent front surface protrusions 13*f* are equal intervals, and as the front end surface 131 of the front surface protrusion 13*f* is a flat surface, the eyelashes or the edges of the eyelashes contact the front surface protrusion 13*f* by plane.

Although the one end 133*f* of the front surface protrusion 13*f* is a flat surface in (A) of FIG. 11, as illustrated in (B) of FIG. 11, one end 133*g* of a front surface protrusion 13*g* may be a curved surface protruding outward. Further, although an upper surface of the front surface protrusion 13*f* is a flat surface in (A) of FIG. 11, as illustrated in (D) of FIG. 11, an upper surface of a front surface protrusion 13*h* may be a curved surface protruding upward.

Further, a contacting surface may not be provided at the entire surface of the front surface 11. For example, the contacting surface may be partially provided as a front surface protrusion 13*i* illustrated in (E) of FIG. 11. A plurality of groove portions (not illustrated) in the width direction may be provided at a portion of the front surface of the base portion 19 where the front surface protrusions 13*i* do not exist.

Further, the front surface protrusions may be aligned in two lines. When the front surface protrusions are provided in two lines, front surface protrusions 13*j* may be provided to contact with each other as illustrated in (F) of FIG. 11, or front surface protrusions 13*k* may be provided with a space therebetween (in two lines) as illustrated in (G) of FIG. 11. A plurality of groove portions (not illustrated) in the width direction may be provided at a portion of the front surface of the base portion 19 where the front surface protrusions 13*k* do not exist.

(Modified Examples of Back Surface Protrusions)

Figure 12:
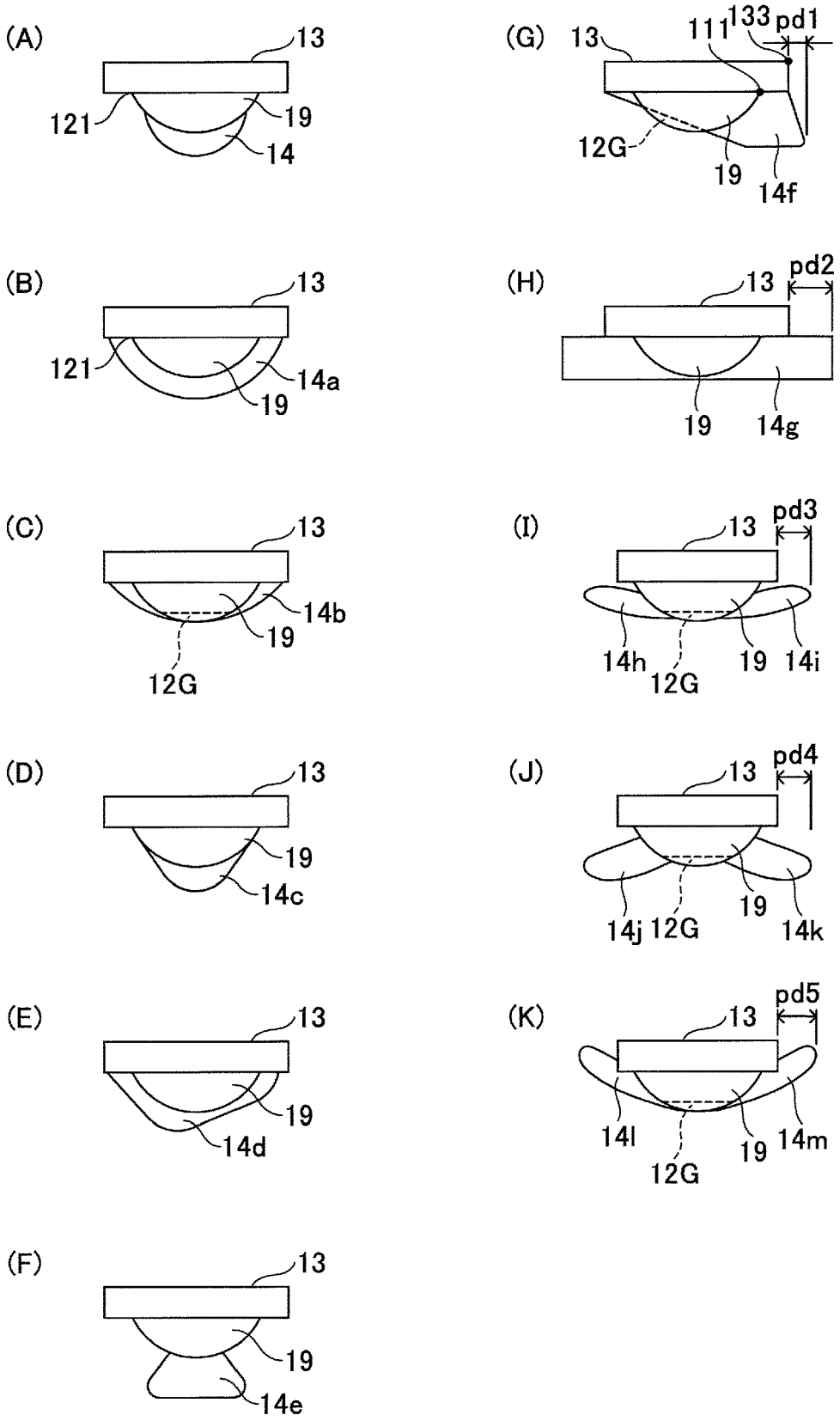
FIG. 12 is a cross-sectional view of a plurality of modified examples of a back surface protrusion of the invention.

(A) to (K) of FIG. 12 are cross-sectional views of a plurality of modified examples of the back surface protrusions of the invention.

(A) of FIG. 12 illustrates a cross-section of the mascara application body 10 including the back surface protrusion 14 corresponding to the above described embodiment (FIG. 2, FIG. 3, FIG. 6 and the like, for example). In (A) of FIG. 12, the protrusion 14 has a linear-symmetrical crescent shape. However, protrusion starting points of the back surface protrusion 14 may not be included at end portions of the back surface.

For example, a protrusion of the back surface protrusion 14 may exceed the side edge (periphery) 121 of the back surface 12. As illustrated in (B) and (C) of FIG. 12, for example, a back surface protrusion 14*a*, 14*b* may protrude from a position same as the side end 133 of the front surface protrusion 13. Further, the arc shape may not be symmetrical with respect to the base portion 19, and may be asymmetrically inclined.

Here, as illustrated in (C) of FIG. 12, when the back surface protrusion 14*b* does not exist near the center portion of the base portion 19 in the width direction, a plurality of groove portions 12G may be formed at the back surface of the base portion 19 in the width direction.

Further, a top surface (front end surface) of the back surface protrusion 14 may not be necessarily curved over the entire portion. For example, the back surface protrusion 14 may have a quadrangle shape including two or more apexes.

As an example for a case that the back surface protrusion 14 has a quadrangle shape, as illustrated in (D), (E) and (F) of FIG. 12, the back surface protrusion 14 has a trapezoidal shape. At this time, considering safety, corner portions of the back surface protrusion 14*c*, 14*d*, 14*e* may have round shapes. The quadrangle shaped portion or the above described arc shaped portion may not be symmetrical with respect to the base portion 19, and as illustrated in (E) of FIG. 12, may be asymmetrically inclined.

Further, a side end of the back surface protrusion 14 may protrude from a side end of the front surface protrusion 13. For example, as illustrated in (G) of FIG. 12, a portion of "pd1" protrudes from the front surface protrusion 13 at an asymmetrical quadrangle shaped back surface protrusion 14*f*.

Further, when the side end of the back surface protrusion 14 protrudes from the side end of the front surface protrusion 13, the back surface protrusion 14 may protrude at both ends. As illustrated in (H) of FIG. 12, for example, both end portions "pd2" protrude from the side ends 133 of the front surface protrusion 13 in a rectangular shaped back surface protrusion 14*g*.

Alternatively, as illustrated in (I), (J) and (K) of FIG. 12, a pair of back surface protrusions (14*i*, 14*h*), (14*k*, 14*j*) and (14*l*, 14*m*) may be provided to protrude the back surface protrusions 14 with respect to the side ends of the front surface protrusions 13.

As illustrated in (G) to (K) of FIG. 12, when the side ends of the back surface protrusions 14 are protruded with respect to the side ends 133 of the front surface protrusions 13, the back surface protrusions 14 may be used for the raising operation of the roots of the eyelashes as illustrated in (C) of FIG. 6.

If a distance (step) between the side end of the front surface protrusion and the side end of the back surface protrusion is too large (too long) in the structures illustrated in (G) to (K) of FIG. 12, it becomes easy to contact the eyelid. Thus, it is preferable that a distance (pd1, pd2, pd3, pd4, pd5) between the side end of the back surface protrusion 14 and a shorter one selected from the side end 133 of the front surface protrusion 13 or the side edge 111 of the front surface 11 is less than or equal to 1.0 mm.

(Modified Examples of Side Surface Protrusion)

Figure 13:
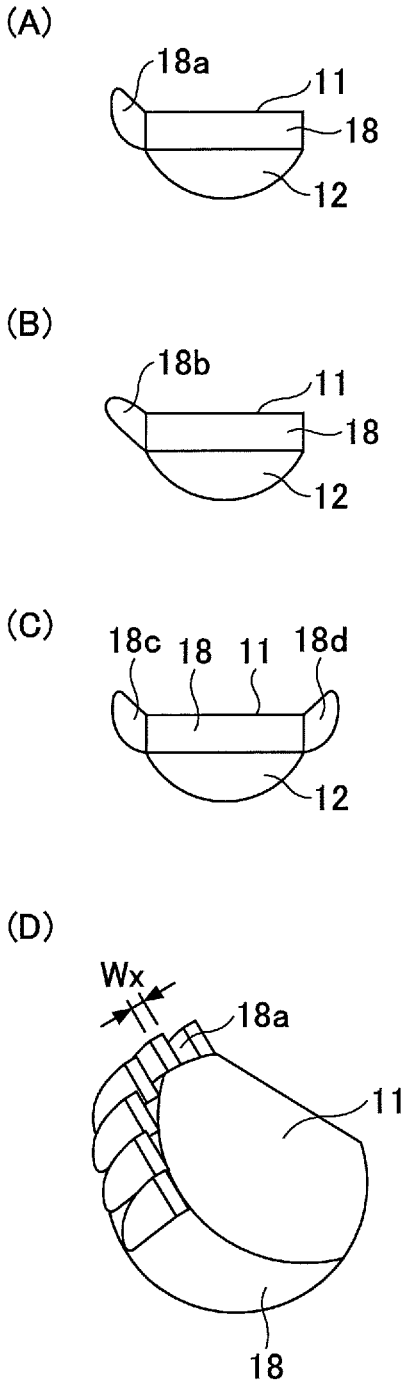
FIG. 13 is a cross-sectional view of a plurality of modified examples of a side surface protrusion of the invention.

FIG. 13 is a cross-sectional view of a plurality of modified examples of a side surface protrusion of the invention. As illustrated in the above described (E) to (G) of FIG. 9, when the side surface 18 is provided between the front surface 11 and the back surface 12, side surface protrusions that protrude from the side surface 18 may be provided.

In examples of FIG. 13, a side surface protrusion is provided to the structure of (E) of FIG. 9. When providing the side surface protrusion, it is preferable that the side surface protrusion protrudes upward with respect to the front surface 11 in order to be applicable to the raising operation of the roots of the eyelashes as illustrated in (C) of FIG. 6.

A standing surface (front side) of the side surface protrusion may be linearly formed as a side surface protrusion 18*a* illustrated in (A) of FIG. 13, or formed as a curve as a side surface protrusion 18*b* illustrated in illustrated in (B) of FIG. 13, for example.

Further, the side surface protrusions may be provided at the both side surfaces 18 as side surface protrusions 18*c* and 18*d* illustrated in (C) of FIG. 13. Here, when providing the side surface protrusion, the side surface protrusion (13*a*, 13*b*, 13*c*) is configured such that corner portions are rounded.

(D) of FIG. 13 is a view of the structure of (A) of FIG. 13 seen from the direction "P" in (A) of FIG. 3 in a simplified manner. The side surface protrusion 18*a* has substantially same width "Wx" at the root and the front end surface of the protrusion in the width direction. Thus, a contact surface with the eyelashes is a planar shape, a curved plane surface or rounded corners, not a sharpened shape, fear that the application body 10 approaches an eye when applying the mascara can be reduced.

Here, although the front surface protrusion 13 and the back surface protrusion 14 are not illustrated in each of the cross-sections of FIG. 13, when providing the side surface protrusion, the side surface protrusion may be provided with the front surface protrusion 13 and/or the back surface protrusion 14, or the side surface protrusion may be provided instead of either of the front surface protrusion 13 and the back surface protrusion 14. When either of the front surface protrusion 13 and the back surface protrusion 14 does not included, a plurality of groove portions (not illustrated) each extending in the width direction of the base portion 19 may be formed.

In any modified examples, similarly as the mascara applicator 40 of the above described embodiment, when applying to the roots of the eyelashes by using the mascara applicator of the plurality of modified examples, fear of contact to the eyeball or the eyelid can be reduced, and a user does not hesitate to apply the mascara to the roots of the eyelashes.

Further, the eyelashes are curled by raising the eyelashes to give volume, and prevent clumps or unevenness to actualize good finishing.

(Modified Examples of Front End Portion)

Figure 14:
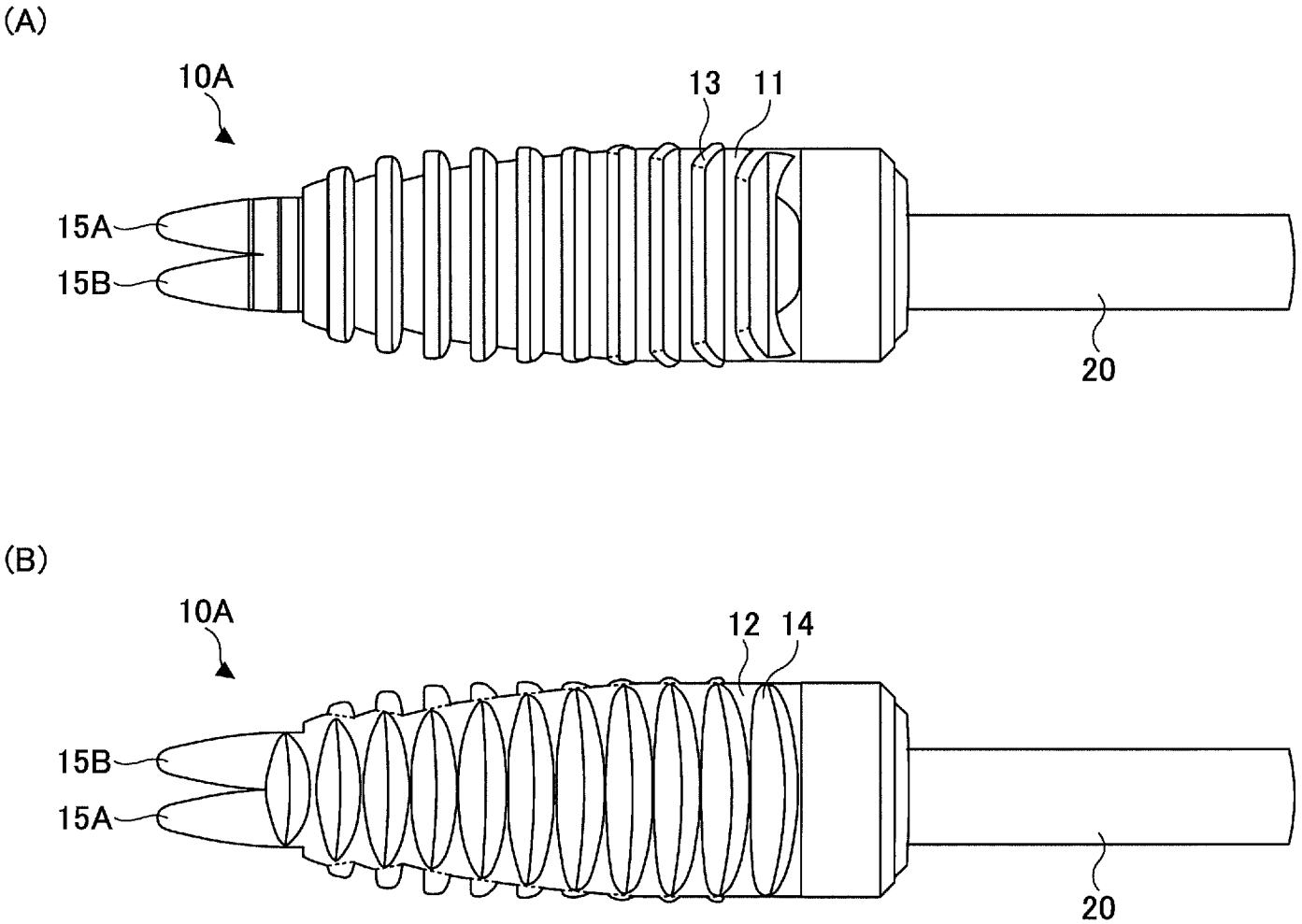
FIG. 14 is an enlarged view of the application body of the mascara applicator of the invention including a modified example of a front end portion of the application body.

FIG. 14 illustrates an example of an application body including a front end portion of a modified example of the invention.

The application body of the embodiment includes two needle-shaped front ends 15A and 15B formed by branching the front end portion into two.

When the application body 10A of the embodiment is used, when combing the eyelashes as illustrated in (F) of FIG. 6, it is possible to comb by using two of the front end portions (needle-shaped front end 15A, 15B) and a groove. However, as the width becomes large compared with the application body 10 (see FIG. 2) of the above described embodiment, a structure may be appropriately selected in accordance with a purpose and a size.

According to the mascara applicator of the embodiment, as the width is large, the eyelashes can be further curled to give volume, and prevent clumps or unevenness to actualize good finishing by the two front end portions, compared with the mascara applicator 40 of the above described embodiment.

Although a preferred embodiment of the invention has been specifically illustrated and described, it is to be understood that the present invention is not limited to the specifically disclosed embodiments, and numerous variations and modifications may be made without departing from the spirit and scope of the present invention.

The present application is based on and claims the benefit of priority of Japanese Priority Application No. 2015-257289 filed on Dec. 28, 2015, and Japanese Priority Application No. 2016-253284 filed on Dec. 27, 2016, the entire contents of which are hereby incorporated by reference.

NUMERALS

1 mascara tool (eye cosmetic tool)
10, 10A application body
11, 11*a*, 11*b* front surface
111 side edge of front surface (periphery)
12, 12*a* back surface
121 side edge of back surface (periphery)
13, 13*a*, 13*b*, 13*c*, 13*d*, 13*e*, 13*f*, 13*g*, 13*h*, 13*i*, 13J, 13*k* front surface protrusion (protrusion)
131, 131*a*, 131*f* front end surface
132 extending portion at side of front surface protrusion (protruding portion)
133, 133*f*, 133*g* side end of front surface protrusion
14 back surface protrusion
15 needle-shaped front end
15A, 15B needle-shaped front end (needle-shaped front end portion)
16 flocking
17 supporting portion
17J connection portion
18 side surface
19 base portion
20 stem
30 gripping portion
40 mascara applicator (eye cosmetic applicator, applicator)
50 mascara container (cosmetic container)
51 scraping member
A axial direction
L longitudinal direction of base portion
S width direction (short direction) of base portion
H height direction of base portion
D distance between front end of base portion and axis
M cosmetic (liquid mascara)
Wc width of front surface protrusion
Wv width of back surface protrusion
Tc height of front surface protrusion
Ic space between front surface protrusions
Gc gap between front surface protrusions

What is claimed is:

1. An eye cosmetic applicator, comprising:

a spindle;

a base portion supported by the spindle; and a plurality of front surface protrusions, formed at a front surface of the base portion, each extending in a direction perpendicular to a longitudinal direction of the base portion, and a plurality of back surface protrusions protruding from a back surface of the base portion opposing the front surface, each extending in a direction perpendicular to the longitudinal direction of the base portion, wherein each of the front surface protrusions is formed to protrude from the front surface of the base portion, at least some of the front surface protrusions includes a protruding portion protruding outwardly from a periphery of the base portion, the base portion is inclined for a predetermined angle with respect to the spindle, the back surface is a protruded curved surface that protrudes outwardly in the longitudinal direction and the front surface is a concaved curved surface that concaves in the longitudinal direction, and, in the longitudinal direction, curvature of the protruded curved surface of the back surface is smaller than curvature of the concaved curved surface of the front surface, the thickness of the base portion becomes gradually thinner as departing from the spindle in the longitudinal direction of the base portion, due to the inclination and the curvature of the front surface and the back surface, and each of the front surface protrusions and the back surface protrusions are prism protrusions each having a rectangular cross-sectional shape or a polygonal cross-sectional shape.

2. The eye cosmetic applicator according to claim 1, wherein the base portion is substantially linearly formed at least at a part at the front surface in a cross-section of the base portion in a width direction.

3. The eye cosmetic applicator according to claim 1, wherein a width of the base portion becomes gradually narrower as departing from the spindle in the longitudinal direction so that the front surface has a lanceolate shape.

4. The eye cosmetic applicator according to claim 3, wherein a needle-shaped front end portion extending in the longitudinal direction is provided at a front end of the lanceolate shape of the base portion, furthest from the spindle in the longitudinal direction of the base portion.

5. The eye cosmetic applicator according to claim 1, wherein flocking finishing is performed at least at a part of the base portion.

6. The eye cosmetic applicator according to claim 1, wherein a front end portion of the front surface protrusions protruding from the front surface forms a flat surface or a curved surface concaved with respect to an extending direction whose width in the longitudinal direction of the base portion, at the widest portion, is greater than or equal to 0.5 mm and less than or equal to 1.3 mm.

7. The eye cosmetic applicator according to claim 6, wherein a front end area of the front end portion of the protrusion obtained by "a length of the protrusion in the extending direction"×"the width of the protrusion" is greater than or equal to 0.6 $mm^2$ and less than or equal to 6.0 $mm^2$.

8. The eye cosmetic applicator according to claim 6, wherein a plurality of the front surface protrusions are aligned such that the front end portions of the plurality of the front surface protrusions are aligned to be a curved shape concaved in the longitudinal direction of the base portion, and wherein a ratio of the width of the front end portion of each of the front surface protrusions and a gap between the adjacent front surface protrusions is greater than or equal to 1:4 and less than or equal to 1:0.8.

9. The eye cosmetic applicator according to claim 1, wherein a front end portion of the protruding portion protruding outwardly from at least a part of the periphery of the base portion forms a flat surface or a curved surface whose width is greater than or equal to 0.5 mm and less than or equal to 1.3 mm.

10. The eye cosmetic applicator according to claim 9, wherein a front end area of the front end portion of the protruding portion obtained by "a height of the protrusion"× "the width of the protrusion" is greater than or equal to 0.2 $mm^2$ and less than or equal to 2.0 $mm^2$.

11. The eye cosmetic applicator according to claim 9, wherein the plurality of protruding portions are aligned such that to be further protruding from the periphery of the base portion as departing from the spindle, and wherein a ratio of the width of the front end portion of each of the protruding portions and a width of a gap between the adjacent protruding portions is greater than or equal to 1:4 and less than or equal to 1:0.8.

12. The eye cosmetic applicator according to claim 2, wherein the back surface is a protruded curved surface that also protrudes outwardly in a width direction, and each of the back surface protrusions protruding from the back surface has a substantially crescent shape whose center portion is the highest and gradually becoming lower toward the extending direction as approaching the peripheries of the base portion.

13. An eye cosmetic tool comprising:

the eye cosmetic applicator according to claim 1;

a gripping portion capable of being connected to the spindle of the eye cosmetic applicator; and a cosmetic container capable of being attached with the gripping portion, and containing a cosmetic.

* * * * *